US010640896B2

(12) United States Patent
Barnes et al.

(10) Patent No.: US 10,640,896 B2
(45) Date of Patent: May 5, 2020

(54) KNIT BRA AND METHOD OF MANUFACTURE THEREOF

(71) Applicant: LULULEMON ATHLETICA CANADA INC., Vancouver (CA)

(72) Inventors: Kristen Elizabeth Barnes, Vancouver (CA); Alexandra Carmela Plante, Vancouver (CA); Yogendra V. Dandapure, Vancouver (CA); Laura Renee Dixon, Vancouver (CA)

(73) Assignee: LULULEMON ATHLETICA CANADA INC. (CA)

( * ) Notice: Subject to any disclaimer, the term of this patent is extended or adjusted under 35 U.S.C. 154(b) by 175 days.

(21) Appl. No.: 15/173,420

(22) Filed: Jun. 3, 2016

(65) Prior Publication Data

US 2016/0353810 A1 Dec. 8, 2016

Related U.S. Application Data

(60) Provisional application No. 62/170,467, filed on Jun. 3, 2015.

(51) Int. Cl.

| | |
|---|---|
| ***D04B 7/30*** | (2006.01) |
| ***A41C 5/00*** | (2006.01) |
| ***A41C 3/00*** | (2006.01) |
| ***D04B 1/24*** | (2006.01) |
| ***D04B 1/18*** | (2006.01) |
| ***D04B 1/10*** | (2006.01) |

(52) U.S. Cl.

CPC ..... *D04B 7/30* (2013.01); *A41C 3/0014* (2013.01); *A41C 5/00* (2013.01); *D04B 1/102* (2013.01); *D04B 1/18* (2013.01); *D04B 1/246* (2013.01); *A41B 2500/10* (2013.01); *D10B 2403/022* (2013.01); *D10B 2403/0331* (2013.01)

(58) Field of Classification Search

CPC ... D04B 7/30; D04B 7/04; D04B 7/10; D04B 1/18; D04B 1/102; D04B 1/246; A41C 3/0057; A41C 3/0014; A41C 3/0085; A41C 5/00

USPC ..... 66/64, 66, 67, 70, 175, 176

See application file for complete search history.

(56) References Cited

U.S. PATENT DOCUMENTS

| | | | | |
|---|---|---|---|---|
| 2,284,167 A * | 5/1942 | Ralston | D04B 7/04 | 66/115 |
| 2,608,078 A * | 8/1952 | Anderson | D04B 1/16 | 28/153 |
| 2,966,785 A * | 1/1961 | Goff | A41C 3/0014 | 450/91 |

(Continued)

FOREIGN PATENT DOCUMENTS

| | | |
|---|---|---|
| CN | 103966752 A | 8/2014 |
| EP | 2759625 A2 | 7/2014 |

OTHER PUBLICATIONS

International Search Report dated Aug. 31, 2016, regarding PCT/US2016035898.

(Continued)

*Primary Examiner* — Danny Worrell

(74) *Attorney, Agent, or Firm* — Bracewell LLP

(57) ABSTRACT

The invention provides bras having enhanced dynamic performance and comfort as well as a method of manufacture thereof. Two-dimensional knitting is utilized to generate three-dimensional structures in the bra that conform to unique three-dimensional shapes of the wearer.

31 Claims, 25 Drawing Sheets

COMBINATION SPACER/PADDING

(56) References Cited

U.S. PATENT DOCUMENTS

| | | | | | |
|---|---|---|---|---|---|
| 3,092,987 | A * | 6/1963 | Levine | A41C 3/06 | 450/93 |
| 3,103,111 | A * | 9/1963 | Rinehart | A41D 7/00 | 66/176 |
| 3,287,937 | A | 11/1966 | Landau | | |
| 3,500,665 | A * | 3/1970 | Schoffner | A41C 3/0014 | 450/70 |
| 3,789,098 | A * | 1/1974 | Cole | A41C 3/0014 | 223/52 |
| 5,692,399 | A * | 12/1997 | Takahashi | D04B 1/22 | 66/170 |
| 6,398,453 | B1 | 6/2002 | Stegemoeller | | |
| 7,549,302 | B2 | 7/2009 | Ouckham et al. | | |
| 7,849,715 | B2 * | 12/2010 | Starbuck | A41C 3/0014 | 66/171 |
| 8,128,457 | B2 | 3/2012 | Reinisch et al. | | |
| 9,538,794 | B2 | 1/2017 | Turlan | | |
| 2003/0106344 | A1 * | 6/2003 | Okamoto | D04B 1/243 | 66/64 |
| 2007/0238392 | A1 | 10/2007 | Starbuck et al. | | |
| 2008/0016918 | A1 * | 1/2008 | Okamoto | D04B 1/24 | 66/67 |
| 2010/0035514 | A1 | 2/2010 | Wong et al. | | |
| 2016/0353810 | A1 * | 12/2016 | Barnes | A41C 3/0057 | |
| 2017/0119063 | A1 * | 5/2017 | Diaz | A41O 5/00 | |

OTHER PUBLICATIONS

CN20160046030.3 Office Action dated Apr. 24, 2019; 9 pgs.
EP16804597.9 Extended European Search Report dated Jan. 23, 2019; 11 pgs.

* cited by examiner

PLAITED SINGLE JERSEY STRUCTURE

KNIT BRA AND METHOD OF MANUFACTURE THEREOF

CROSS REFERENCE TO RELATED APPLICATION(S)

This application claims the benefit of priority under 35 U.S.C. § 119(e) of U.S. Ser. No. 62/170,467, filed Jun. 3, 2015, the entire content of which is incorporated herein by reference in its entirety.

BACKGROUND OF THE INVENTION

Field of the Invention

The present invention relates generally to garments, and more particularly to three-dimensionally knit bras having enhanced dynamic performance.

Background Information

The following description includes information that may be useful in understanding the present invention. It is not an admission that any of the information provided herein is prior art or relevant to the presently claimed invention, or that any publication specifically or implicitly referenced is prior art.

Garments of knitted fabric are suitable for use as athletic garments, such as sports bras and workout pants which are worn during physical activity because of their inherent stretchability and resulting body conformability. Because of the comfort and functionality of such garments, their use is not limited only to wear during physical activities, but are desirable and advantageous for general use as well.

Conventional knitted garments may be formed of knitted fabrics which may be designed to extend around a body part of the wearer, such as the torso in the case of shirts and sweaters. Flat bed knitting is not typically or commercially used to make bras. However, in order to create a comfortable fit and good dynamic performance around the torso and especially in the chest region, additional time consuming and expensive steps are required, such as molding, bonding or cutting and sewing operations in which expensive material is cut away and discarded, and which result in compromises to comfort and/or performance.

The prior art discloses knit garments and methods of producing them. However, it is well known in the art that conventional processes require cutting of a two-dimensional material and joining it to form a three-dimensional shape to provide a customized fit which requires undesired compromises. Garments produced using these conventional methods have a number of deficiencies including: inadequate dampening of movement of portions of the body; problems with encapsulation and compression of body structures; garment associated chaff; insufficient support for larger volume body parts; undesired sensation and feel; insufficient thermal comfort; and lack of adequate fit across an entire size range without requiring undesirable compromises, i.e., cutting and joining. As such, a need exists for a method of generating a garment, as well as garments in which the above identified deficiencies are mitigated.

SUMMARY OF THE INVENTION

The present invention provides an enhanced seamless bra having high performance and/or comfort and method of manufacture thereof. The present invention employs advances in flat bed knitting technology to create unique fabric and garment constructions in which the above identified deficiencies are mitigated.

In one aspect, the invention provides a bra having enhanced performance and comfort in which the bra includes a first region having a first structural property, and a second region having a second structural property, the first and second regions being joined by a seamless transition.

In particular, the present invention utilizes a dual bed, v-bed knitting machine in which both front and back beds of the machine are used to knit a three-dimensional structure of the bra, such as the breast cup. The innovative knitting technique allows for generation of bras that have enhanced dynamic performance and comfort as well as a number of additional benefits.

In embodiments, the bra may include multiple three-dimensional structures formed by knitting, each shaped to conform to a three-dimensional shape of the wearer. In various embodiments, the bra may include one or more types of fabrics, each of which may be composed of one or more yarns having strands of various types to enable regions of the bra to exhibit different properties, such as varying stretchability, durability, thermal comfort, chaff and feel.

In another aspect, the present invention provides a bra having a cup region comprising a first high elasticity knit layer opposite or adjacent a low elasticity knit layer (a semi rigid layer). In embodiments, the high elasticity layer forms the inside layer of the cup directed toward the skin. In some embodiments, one or both the layers is texturized by treatment with a gas.

In another aspect, the present invention provides a method for producing a bra of the present invention, in which the fit may be optionally personalized to the wearer. The method includes obtaining dimensions of a three-dimensional shape of a wearer of the bra; and generating the bra such that the bra includes at least one region having a three-dimensional structure having a shape conforming to the three-dimensional shape of the wearer, wherein the three-dimensional structure is formed from the innovative knitting process described herein.

Various objects, features, aspects and advantages of the inventive subject matter will become more apparent from the following detailed description of preferred embodiments, along with the accompanying drawing figures in which like numerals represent like components.

BRIEF DESCRIPTION OF THE FIGURES

FIG. 3A is a schematic of the bras according to FIGS. 1 and 2 including additional knitted tunnels at specific locations and that have elasticated and non-elasticated threads to allow users to adjust the bra fitting for various activities.

FIG. 3B is a schematic of the bras according to FIGS. 1 and 2 including additional knitted tunnels at specific locations and that have elasticated and non-elasticated threads to allow users to adjust the bra fitting for various activities.

FIG. 4A shows an interlock gating structure for the under band or chest band region in embodiments of the present invention.

FIG. 4B shows an interlock gating structure for the under band or chest band region in embodiments of the present invention.

FIG. 4C shows a rib gating structure for the under band or chest band region in embodiments of the present invention.

FIG. 4D shows a rib gating structure for the under band or chest band region in embodiments of the present invention.

FIG. 5A is a schematic showing a half Milano structure.

FIG. 5B is a schematic showing a full Milano structure.

FIG. 5C is a schematic showing a full Cardigan structure.

DETAILED DESCRIPTION OF THE INVENTION

Figure 1:
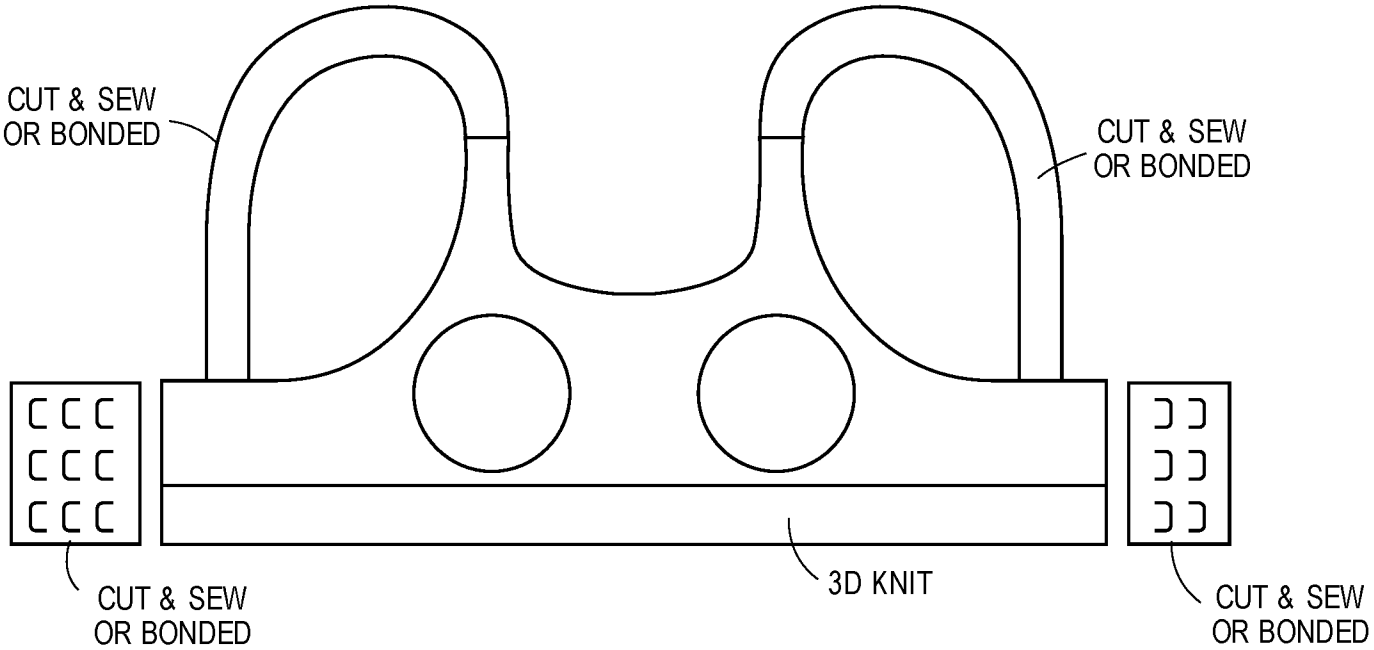
FIG. 1 is a schematic of a bra according to an embodiment of the invention. The bra includes a front that includes wings and bra cups that are knit while the remainder of the components (straps and clasps) can be cut and sewn or cut and bonded to the front of the bra.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein a "wearer" is intended to include a human subject, such as a male or female subject. However, a "wearer" may also include a mannequin, such as a lay figure or dress form. As such, the garments of the present invention may be produced to be custom fitting garments sized to an individual wearer, or they may be produced to be generally custom fit to a particular size of wearer. Accordingly, the present invention includes methods for generating custom fit garments unique to an individual subject or more broadly, to a particular size wearer.

The present invention provides an enhanced seamless bra having high performance and/or comfort and method of manufacture thereof. As discussed above, the present invention utilizes a dual bed, v-bed knitting machine in which both front and back beds of the machine are used to knit a three-dimensional structure of the bra, such as the breast cup. The innovative knitting technique allows for generation of bras that have enhanced dynamic performance and comfort as well as a number of additional benefits.

As used herein, a bra is intended to include a garment that partially or entirely wraps the torso of the wearer and optionally the neck and upper limbs (i.e., arms). Such bras include by way of illustration, breast supports, athletic bras, shirt and hooded type garments, and the like so long as the garment provides breast support.

The inventors have utilized particular functionality of v-bed knitting machines to achieve knitting of the bra described herein. In particular, specific functionalities of the machines opens up new, innovative possibilities of making very unique fabric and garment structures that creates new ways of making garments and building functionalities. Such abilities include, for example the ability to control a single knit stitch as well as have up to 36 individual threads to knit that can be moved across the width of the knitting machine autonomously; the ability to transfer stitches and move (rake) the needle beds; and the ability to add intarsia structure. These functionalities make garment construction much easier and avoid several compromises one has to make in creating complex garments, such as a bra of the present invention.

The methodology described herein provides the following benefits and advancements.

Dampening of Breast Movement Through Cup Engineering.

Engineered cup reduces dampening coefficient to solve for breast discomfort in high impact activities through seamless three-dimensional cup shape, differential fabric modulus and gradient of spacer thickness.

Encapsulation and Compression.

The methodology of the present invention allows for construction of specific encapsulation (shape, pressure, contouring) around the base of the breast and compression on the breast that helps to reduce the breast bounce without bulky mixed-fabric construction currently used in the industry.

Chaff Reduction.

Reduced chaff is achieved by eliminating seams and/or fabric transition areas in current high-support bras through seamless transition between various zones of differing fabric properties as well as specific yarn selection.

Support for Large Volume Body Parts.

Traditional molded cup technologies do not support large volume bras because there is a loss of compressive power of the fabric. This is solved via the knitting methodology of the present invention in which fabric is not heated or pressured (which results in deformation and loss of compressive power) and as a result does not cause loss of stretch and recovery property of the fabric.

Desired Sensation.

Traditional bras do not provide sufficient static and dynamic comfort and performance. The present methodology utilizes intentional yarn, fabric and construction combinations (e.g. yarn size, yarn composition, textures, materials) to achieve desired fit, fashion and function sensations and to improve perception of static feel and dynamic support without compromise. The methodology allows for a high degree of variability of modulus, yarn, and knitting constructions to provide ideal comfort.

Thermal Comfort.

Traditional bra construction does not provide sufficient thermal regulation. The present methodology accomplishes ideal thermal regulation by: 1) reducing heat-trapping layers and bulk required in traditional bra manufacturing to achieve equivalent high-support in overall bra without trapping moisture; 2) body mapping with no seams to achieve comfort needs of various areas across the chest, breasts and back; 3) variable fabric structures built seamlessly in at high-sweat areas to allow heat to escape (e.g. mesh); and variable yarn zoning for cooling and moisture-moving for moisture management.

Fit without Compromise.

The present methodology provides for a superior fit across entire size ranges through engineered bra structure, which is not currently possible without compromise using current manufacturing technologies.

In various embodiments of the invention, knit construction can seamlessly be transitioned into various zones of the bra, i.e., wings, cups, cup cradles and center front, where these different zones may be knitted using different knit techniques to achieve desired shapes, elasticity and stability. The gating of needle beds may be changed as well as the yarns that are being fed into the machine. This methodology provides the freedom of creatively using all possible weft knit constructions that can be made using single and double needle beds.

To achieve a bra having one or more of the desired properties described herein, the bra is generally formed to conform to three-dimensional shapes of the wearer by utilizing a dual bed, v-bed knitting machine in which both front and back beds of the machine are used to knit a three-dimensional structure of the bra, such as the breast cup.

FIGS. 1-3 and 8 set forth illustrative examples of a bra of the present invention. The bras generally include various regions, including wings, cups, cup cradles, center front and straps.

In one embodiments, the bra illustrated in FIG. 1 is provided which includes a front that includes wings and bra cups that are knit while the remainder of the components (straps and clasps) can be cut and sewn or cut and bonded to the front of the bra.

Figure 2:
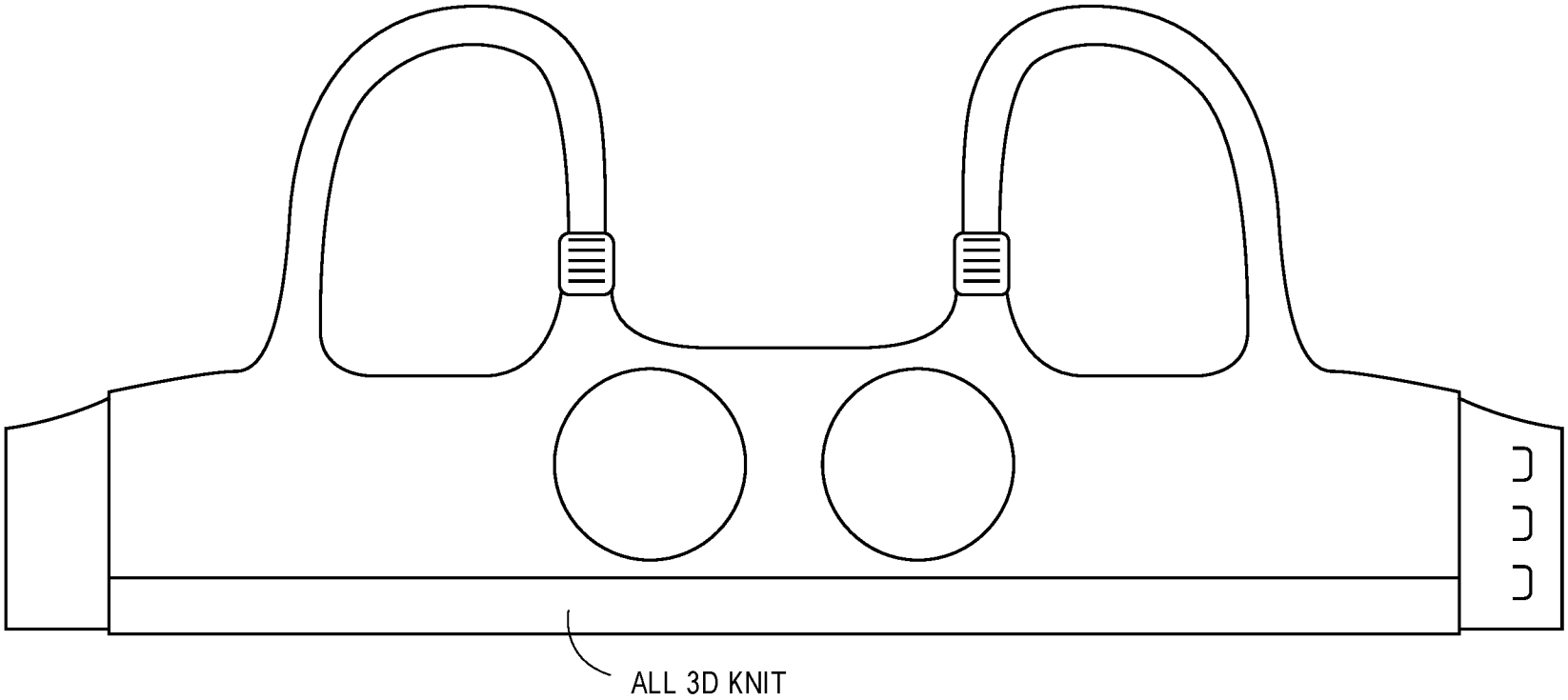
FIG. 2 is a schematic of a bra according to an embodiment of the invention. The bra is entirely knit including the front portion, shoulder straps as well as hook and eye closure which may be knitted into the wings.

In one embodiments, the bra illustrated in FIG. 2 is provided which is entirely knit including the front portion, shoulder straps as well as hook and eye closure which may be knitted into the wings.

Figure 3A:
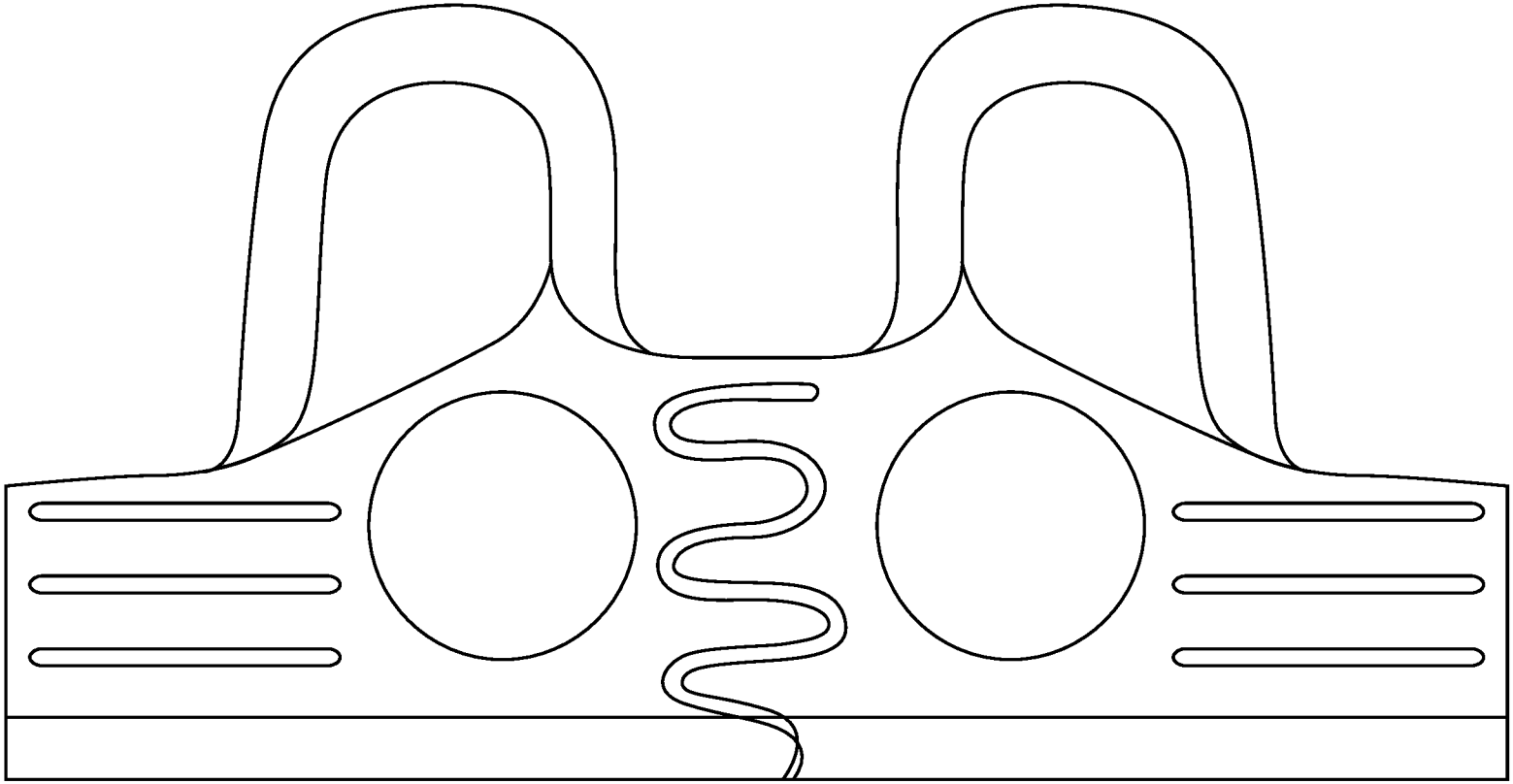
FIGS. 3A-3B are schematics of the bras according to FIGS. 1 and 2.
Figure 3B:
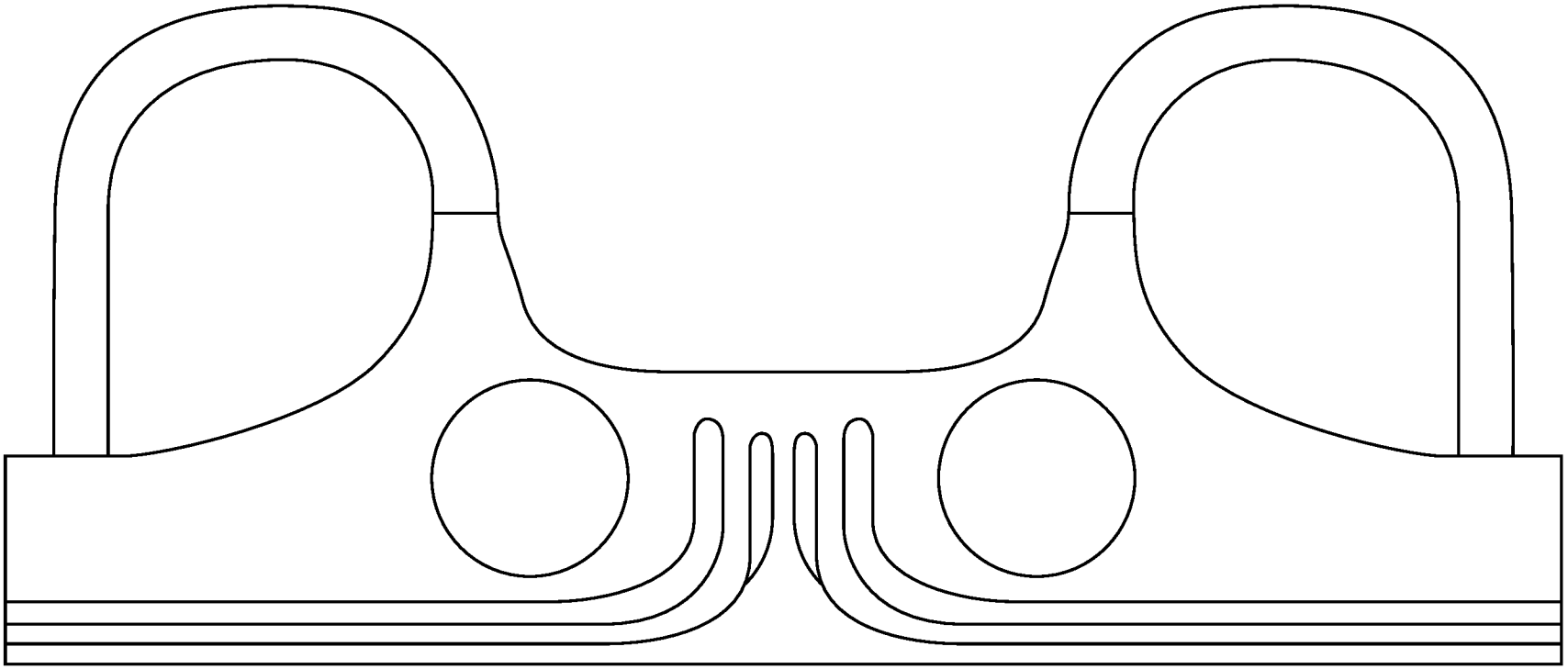
Figure 4A:
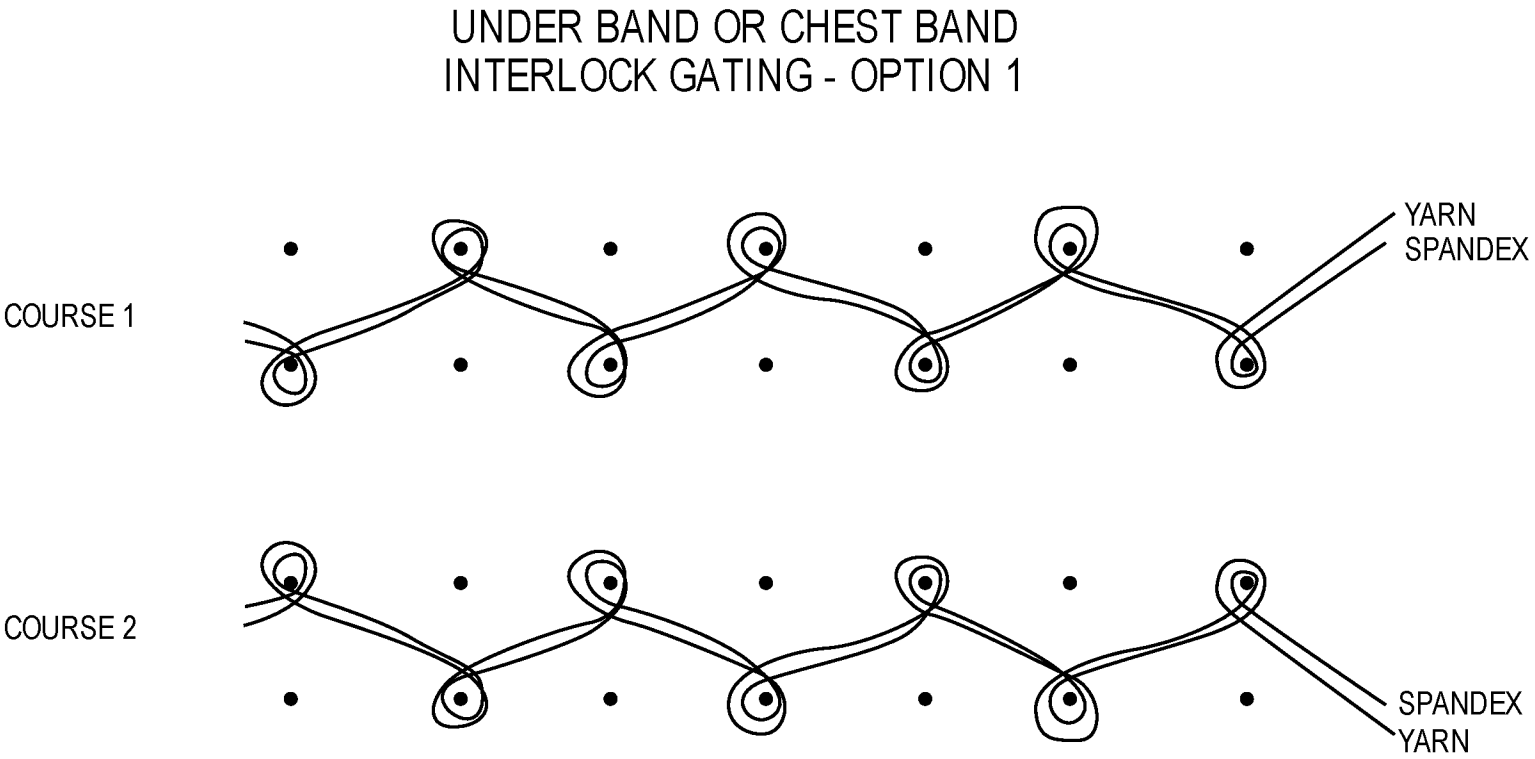
FIGS. 4A-4D are schematics of various knit structures that may be incorporated into the bra in embodiments of the present invention in order to enhance dynamic performance.
Figure 4B:
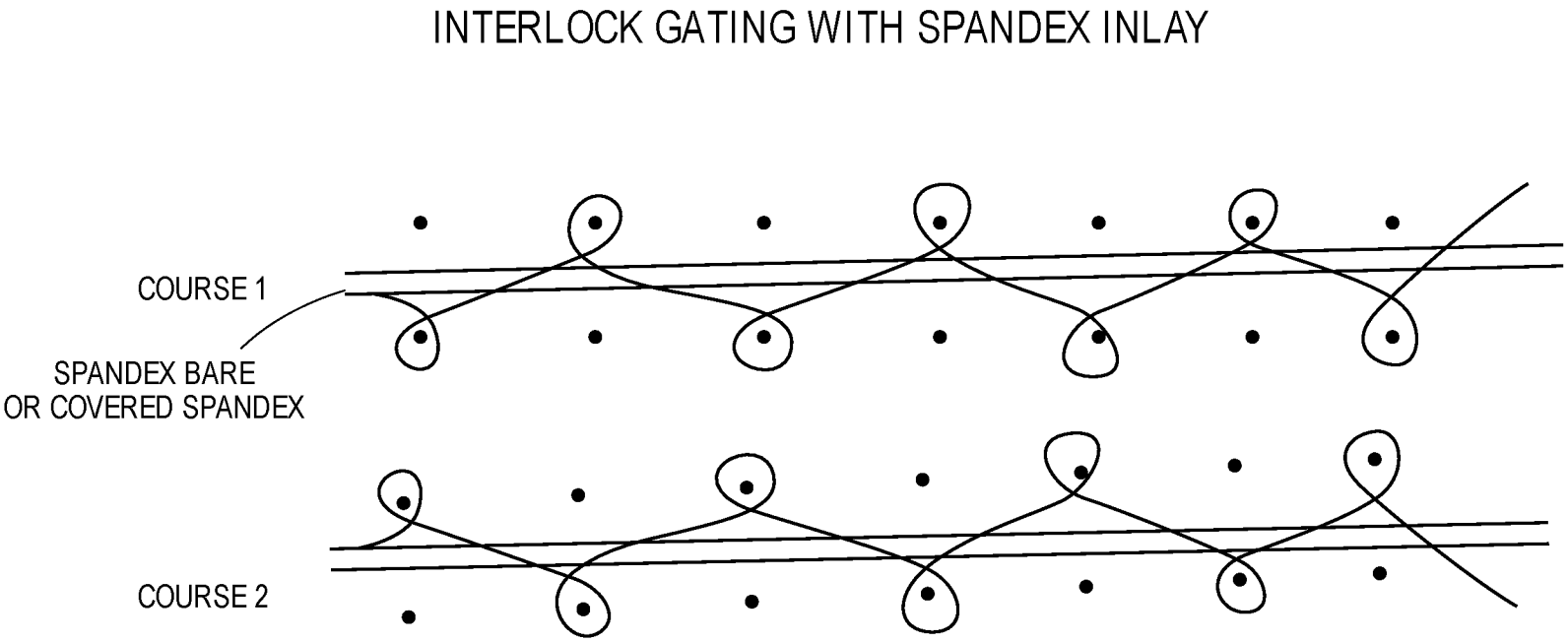
Figure 4C:
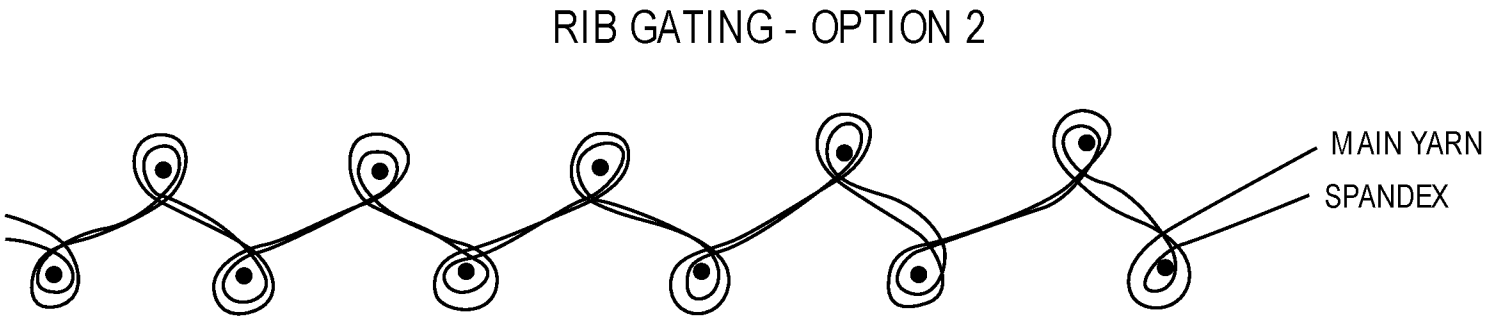
Figure 4D:
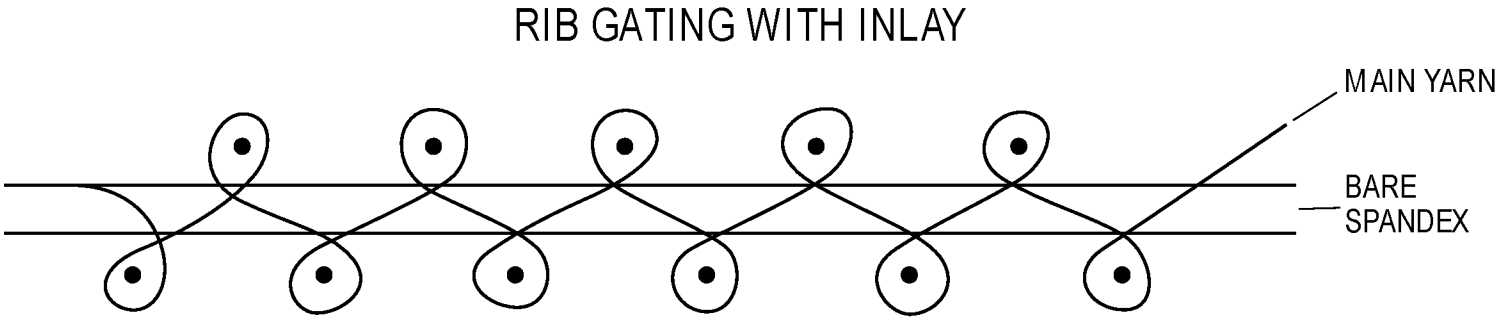

In other embodiments, the bras illustrated in FIGS. 3A and 3B are provided which include additional knitted tunnels at specific locations and that have elasticated and non-elasticated threads to allow users to adjust the bra fitting for various activities.

The present invention allows for a bra to be produced which may have any number of three-dimensional structures. In embodiments, each structure may be designed to conform to different topographies of the wearer's body to optionally provide a bra having a customized fit. As such, a variety of different types of bras may be generated having enhanced comfort and performance and optionally a fit customized to an individual wearer. In general, a bra may include a region in which three-dimensional knitting has been utilized to generate a three-dimensional structure and also include regions having fabric that has been treated utilizing customary approaches, such as cutting, sewing and molding.

Ideally, the bra has a first region having a first structural property, and a second region having a second structural property, the first and second regions being joined by a seamless transition. Regions having different structural properties are defined in greater detail throughout and include for example, structural properties defined by elasticity, coefficient of friction, knit and braid type, yarn treatment and the like.

In practicing the invention, a bra of the present invention may be generated by first obtaining the dimensions of the topography of the region of the wearer's body to be covered. Next, the bra is formed incorporating regions in which the methodology of the present invention is utilized to generate three-dimensional structures in the bra as described herein.

In various embodiments, three-dimensional knitting of the bra of the present invention may conveniently be performed by a knitting machine. Examples of suitable knitting machines for use with the present invention are those described in European Patent Nos: 1620591, 1620590, 1641970, 2188424, and 2331735, the disclosures of each of which are incorporated herein by reference in their entireties. Computerized knitting systems utilizing CAD systems to drive production of a fabric have also been developed, including the SDS-ONE APEX3™ (Shima Seiki Mfg., Ltd. of Wakayama, Japan) workstation.

The present methodology utilizes from 8 gauge to 24 gauge knitting machines with the number of needles per inch from 8 to 24. Additionally, positive yarn feeders on the knitting machine are utilized to precisely control the yarn tension resulting into the desired knit stitch length and density.

Custom fitted dimensional portions of a bra (such as a bra cup sized for the wearer) may be best produced by a CAD-driven computerized flat-bed knitting technique.

Figure 5A:
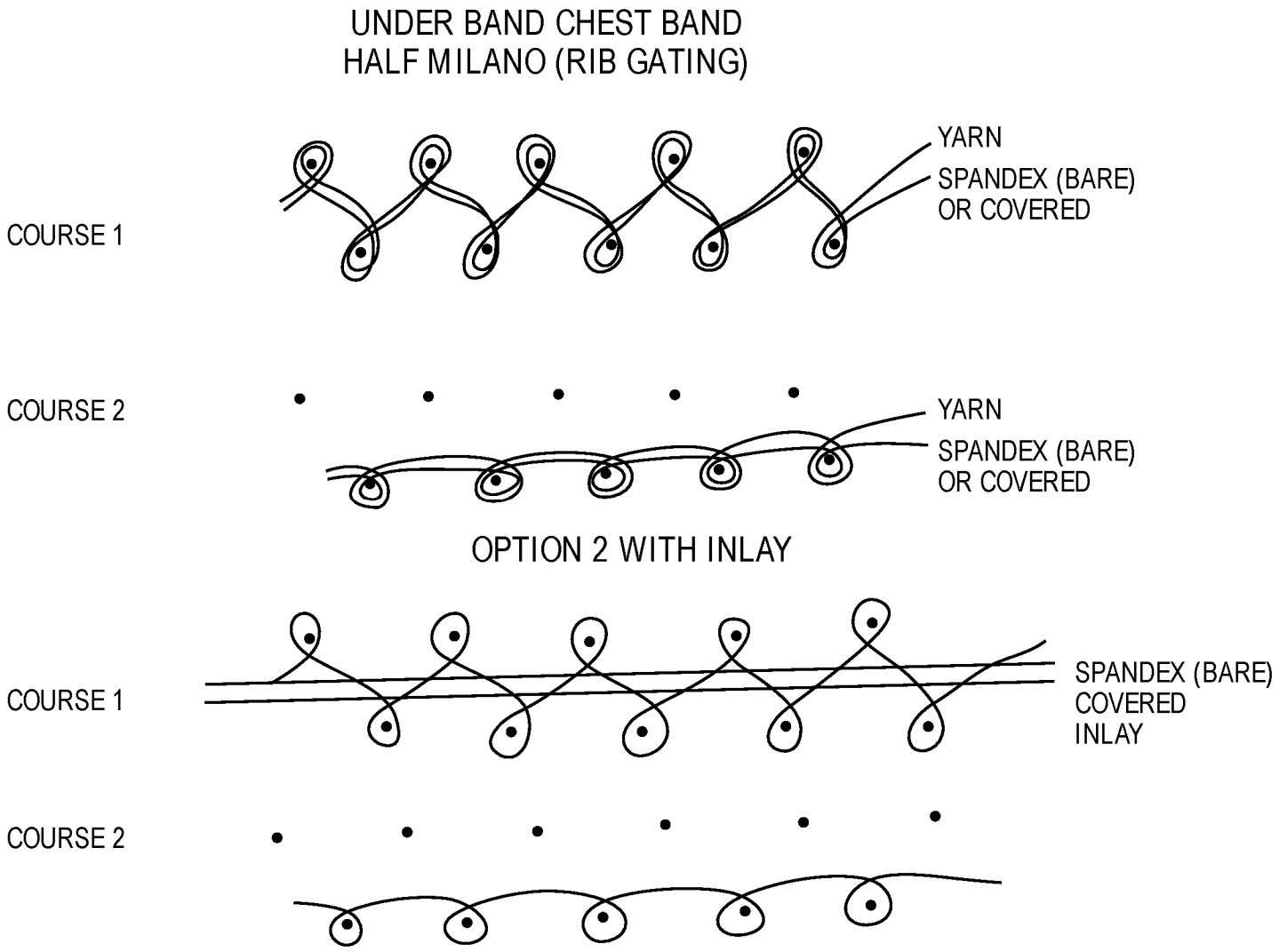
FIGS. 5A-5C are a series of schematics of various knit structures that may be incorporated into the bra in embodiments of the present invention.
Figure 5B:
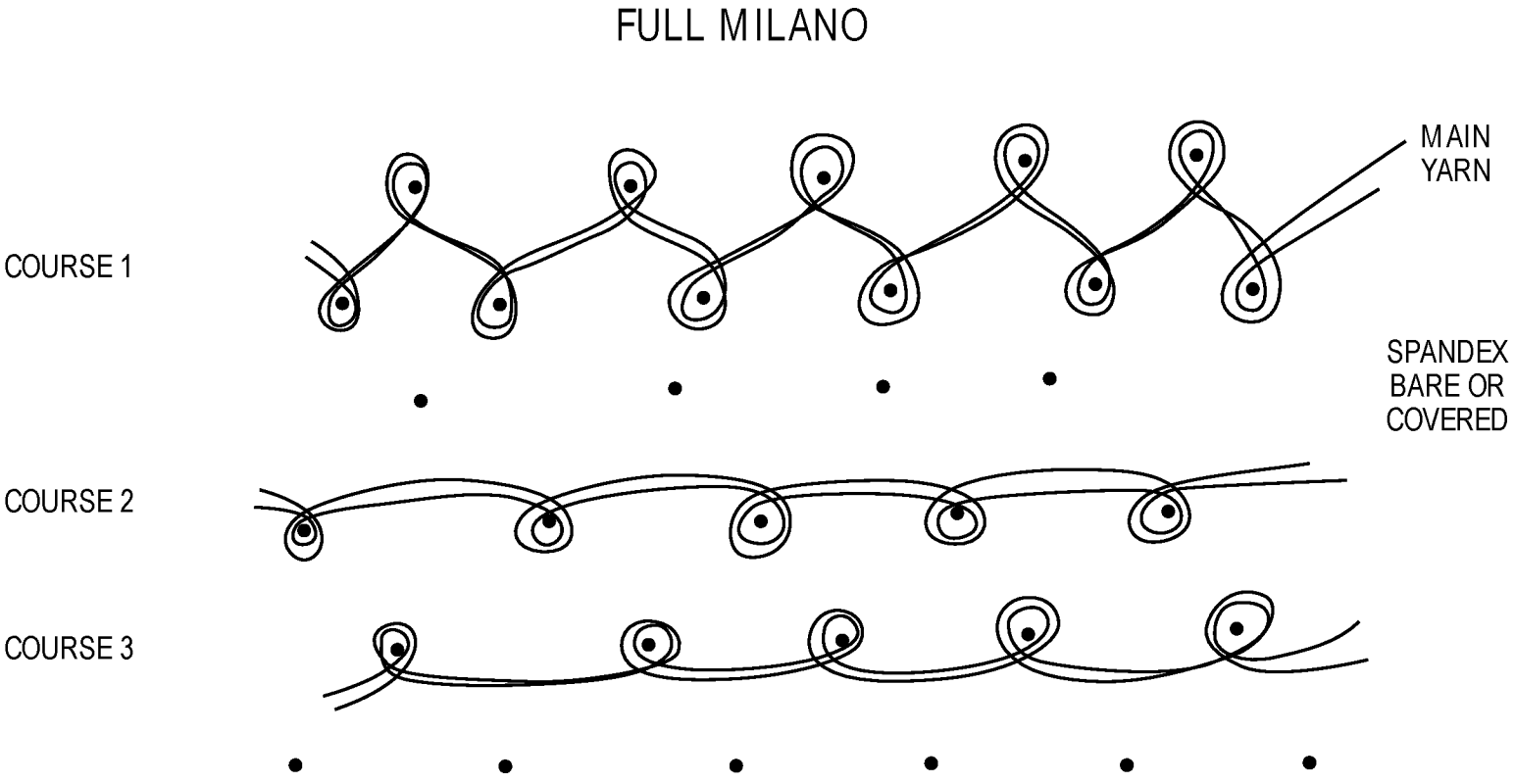
Figure 5C:
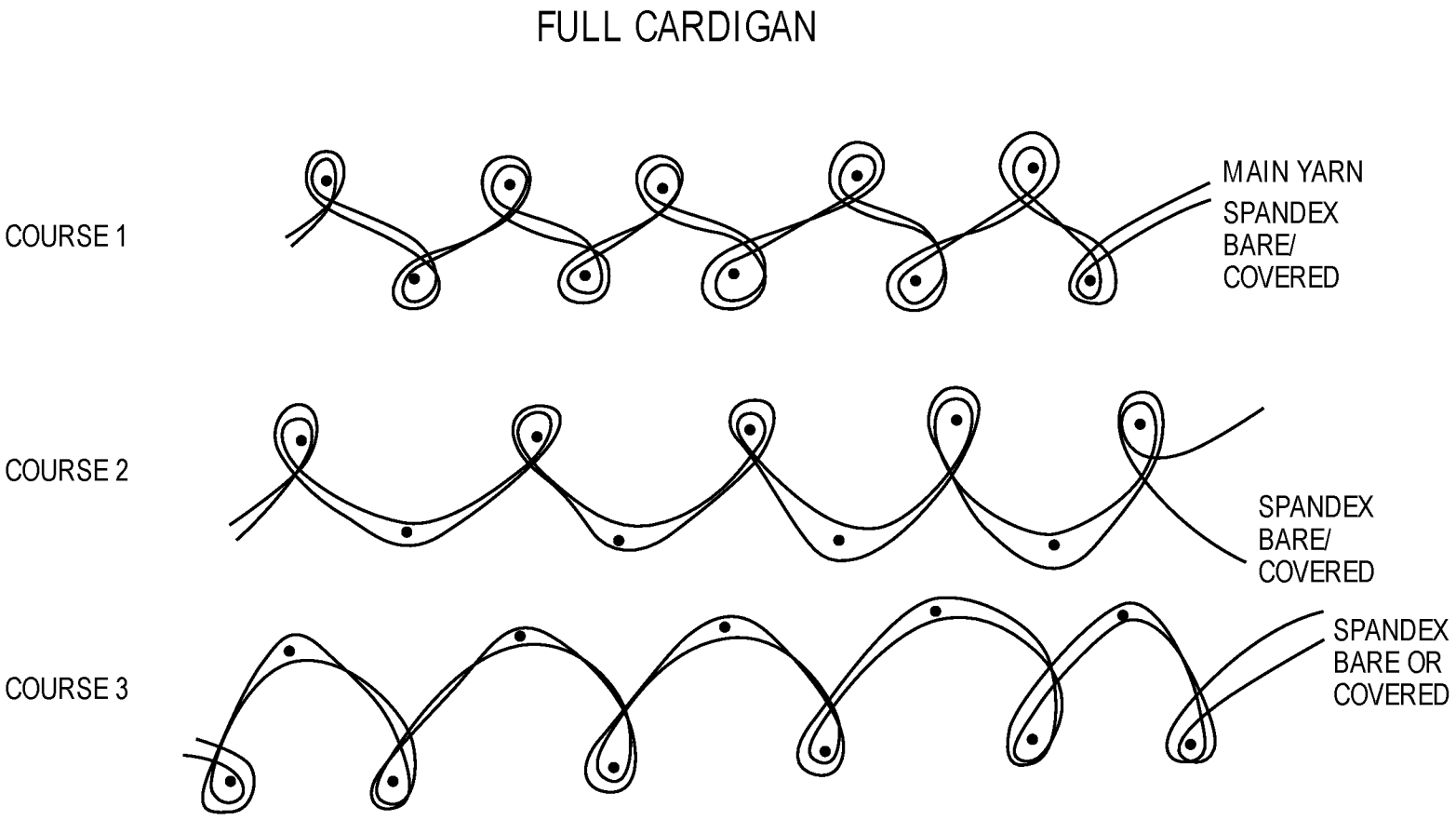

With regard to the chest band and under band, there are six basic double knit structures and their combinations that may be utilized to construct the under band to give desired support to the bra, provide structure as well as comfortable fit, and desirable stretch and recovery properties. Some of these structures include half Milano, full Milano, half cardigan, full cardigan, interlock and rib. FIGS. 4A-4D illustrate specific examples. In one embodiment the under band can be knitted using interlock structure with plaited spandex. In one embodiment a spandex can be inlaid to get better band stability, stretch and recovery. Additionally, FIG. 5 illustrates examples with half Milano, full Milano, full Cardigan, interlock and rib where the spandex or covered spandex can be plaited or inlayed.

Typically the yarns used in the chest band and under band are larger in size or doubled than as compared to the yarns in the remainder of the bra.

Figure 7:
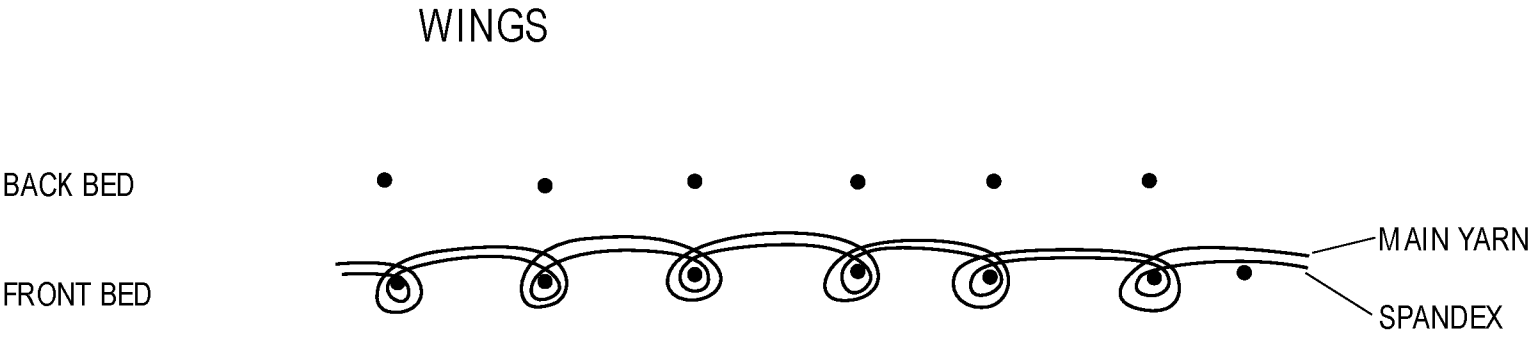
FIG. 7 is a schematic showing a plaited single jersey structure for use with wing regions of the bra in embodiments of the present invention.

With regard to wing zones, in one embodiment these may be constructed using single jersey plaited with spandex or covered spandex. The wings can be knitted using half Milano or full Milano structure or rib or interlock with spandex or spandex covered yarns plaited as illustrated in FIG. 7. In embodiments, thermoplastic yarns may be included in this knit structure that can be fused upon finishing of the fabric to achieve non-stretch structures in the wings.

As to the cup cradle regions, this region needs to provide stability and hence no stretch in length. This zone may be constructed using single jersey, half Milano or full Milano structure with or without spandex or spandex covered yarn plaited.

Figure 6:
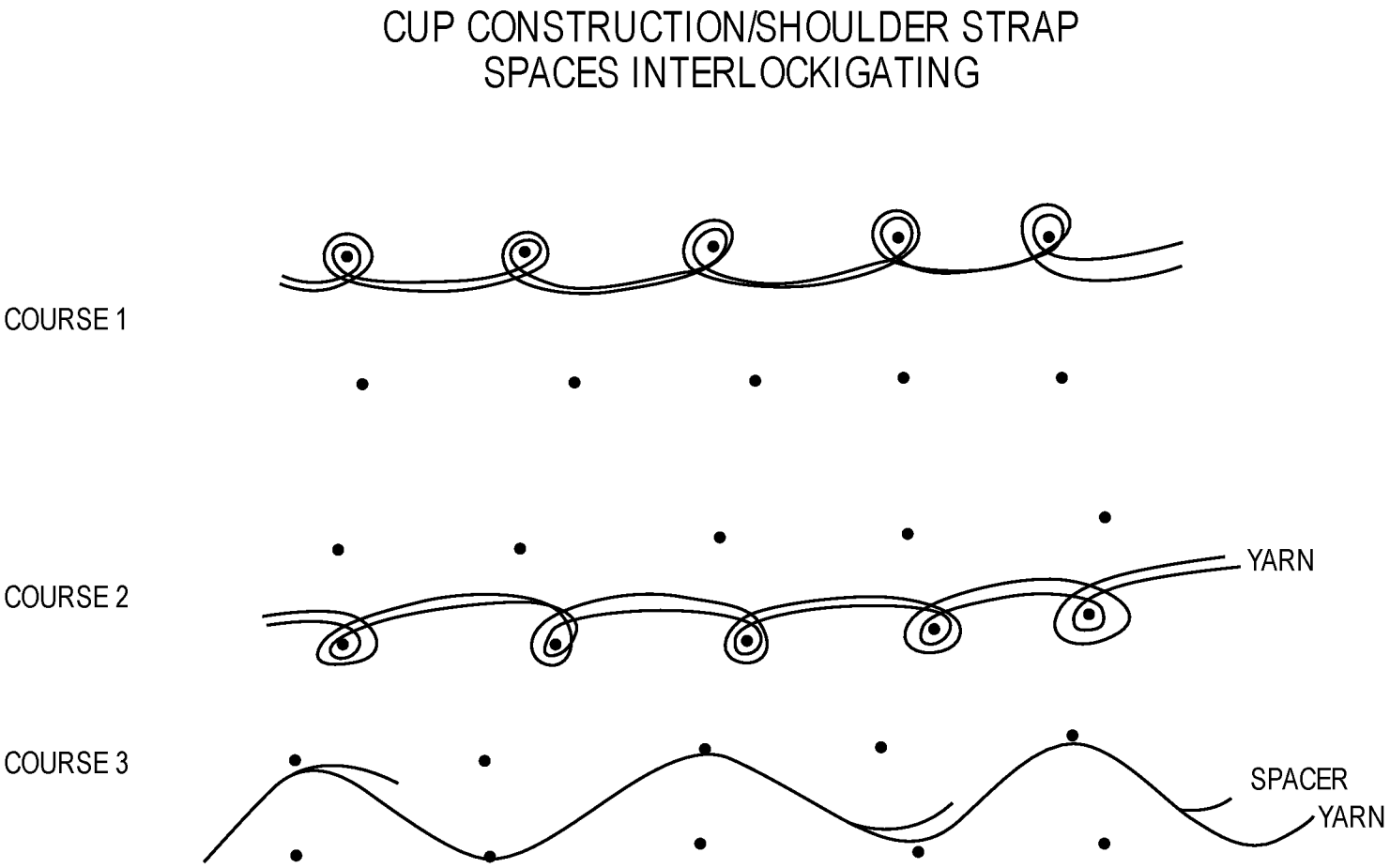
FIG. 6 is a schematic showing a knit structure that may be incorporated into the bra in embodiments of the present invention.

As to the cup regions, this region of the bra may be constructed using double jersey spacer knit technique as shown in FIG. 6. This provides thickness and cushion to the fabric as well as modesty to the wearer. The shoulder strap region may be constructed in similar way to achieve cushion and non-stretch in the shoulder straps.

The center front region is ideally non-stretch and breathable which is achieved using mesh construction achieved by knit, tuck and miss loop combination to achieve a mesh construction that can be double jersey or single jersey based.

As discussed herein, the machines may be configured in a variety of ways such that fabrics disposed in different regions of the bra may be imparted with a variety of different combinations of yarns. In general, fabrics for use in the present invention are manufactured from yarn that is produced from a plurality of strands.

The use of various yarns allows for creation of a bra that includes regions that have variable stretchability or thickness to impart additional conformability and comfort into the bra. For example, a fabric in a given region of a bra may include one, two or more types of yarns. Further, each yarn may include one, two, or more types of strands. By incorporating different yarn types, different regions of the bra may incorporate different fabrics to impart a particular property into a particular region of the bra.

Some yarns that may be utilized include propylene, nylon, polyester and the like. In one embodiments a combination of propylene, nylon and polyester yarns are utilized to varying degrees to achieve a varied degree of stretch, elongation, softness and moisture management.

Additional yarns that may be utilized include spun yarns. Such yarns may be a single material or a blend of one or more of polyester and/or nylon, such as polyester cotton, cotton nylon, Tencel®, Micromodal®, Modal® blended with cotton or polyester, Merino wool, alpaca fleece, polyester and Merino wool/nylon.

In general, the present methodology utilizes finer denier yarns than those that are typically used on v-bed knitting machines. Traditional v-bed knit garments use 2-20 gauge coarse yarns. However, the present invention utilizes functional yarns (engineered wicking yarns) because they are produced in smaller sizes for use in finer gauge machines. To use these finer yarns in a v-bed machine would be slow and thus expensive. As such, they are combined using methods such as air texturizing, draw texturizing, and false twist texturizing, which allows production of fabric at an acceptable speed, cost and quality, with great greater comfort and performance due to more desirable yarns. In the present invention, functional yarns that are typically used in fine gauge fabrics may be combined together by different methods to make a thicker yarn to be able to knit efficiently on a v-bed machine while providing a finer fabric appearance and hand feel. Without limitation, examples include 200 denier, 200 filament air texturized nylon.

The present invention utilizes yarns of a wide variety of sizes, but those that are finer denier yarns than those typically used on v-bed knitting machines as discussed above. In embodiments, the yarn size range for filament synthetic yarns is from about 50 denier to 300 denier, for example, about 200 to 250 denier. In one embodiment, the synthetic yarn is a PTFE yarn and/or fluoropolymer yarn (both manufactured by Toray, AY00-00200-0067 (200 denier) and AYb0-00250-0067 (250 denier))

The yarn size range for multiple ends of yarns is from about 50 denier to 300 denier, for example, about 200 to 250 denier. In various embodiments, spandex for use with the invention may be bare or covered spandex that can be plaited or knitted as is with a size range from about 20 denier to 300 denier. Further, spandex may be optionally covered by nylon or polyester textured yarn. For spun yarns, a size range of from about 16 Ne to 120 Ne is contemplated as single yarns or as doubled or multiple ends together. Additionally, the yarns utilized in the present invention may of varying textures. These include yarns that are fully drawn, draw texturized, false twist texturized and air jet texturized.

Specifically exemplified yarns (also referred to herein as "main" yarns) include, but are not limited to 2 ply, 88 denier, 96 filament (air texturized, draw texturized); 2 ply, 60-200 denier, 96 filament (air texturized, draw texturized); 165 denier, 136 filament (air texturized yarn); 2 ply, 80 denier, 78 filament (draw texturized yarn). The yarn is optionally air texturized using gas to achieve a suitable hand feel. In embodiments, the yarn has a star, plus or dog bone shaped cross-section and is composed of a polymer such as Nylon 66, Nylon 6, or Polyester. Additionally, the yarn is optionally plaited with spandex (from 30 denier to 300 denier), such as 105 denier spandex.

Figure 8:
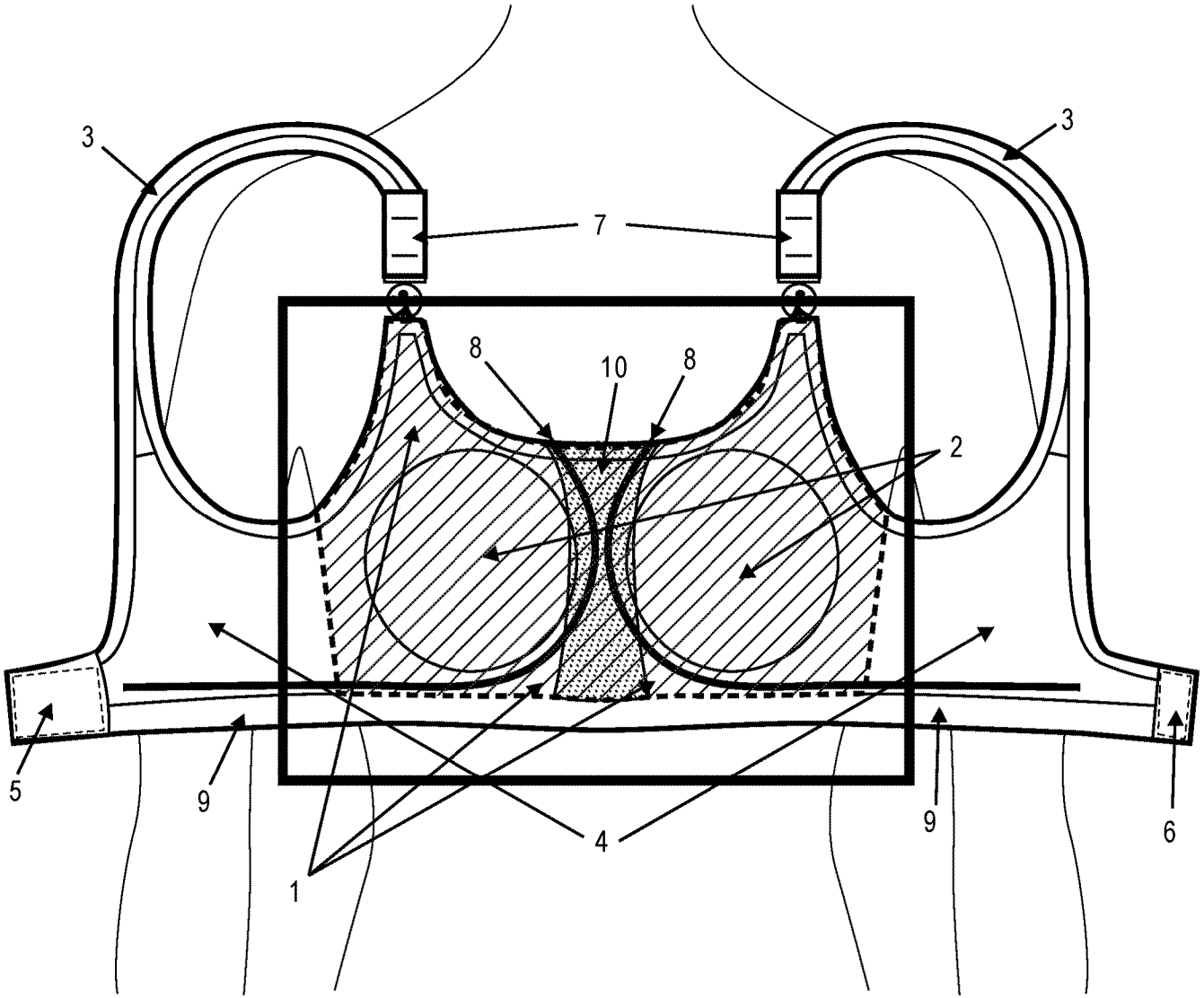
FIG. 8 is a schematic of a bra according to an embodiment of the invention having specified fabric zones as further described herein.

With reference to the embodiment depicted in FIG. 8, fabric frame (1) is constructed of an interlock knit structure built using both beds of a v-bed knitting machine, the region having limited stretch in width and no stretch in length. Regions (2) may be formed of fabric utilizing yarn including strands having moderate stretchability. Such strands may be formed of a material such as lycra or nylon. Regions (2) may be disposed within the non-stretch structural fabric frame (1). The bra also includes straps (3) that are formed of fabric utilizing yarn including strands having relatively low elasticity. Such strands may be formed of a material such as a nylon monofilament or textured polyester. Regions (2) and straps (3) utilize spacer fabric construction with mono or multifilament yarn between the front and back of the fabric. Straps (3) may further include fasteners (7) for attaching the straps (3) to the frame (1). In an alternative embodiment, straps (3) may be formed integral with frame (1). In the embodiment of FIG. 8, wing regions (4) are included which are formed of fabric utilizing yarn including strands which are relatively elastic to allow the hook (6) and eye (5) to be clasped at the back of the wearer by stretching wings (4) which are constructed using double jersey or rib construction. The bra may also include a banded region (9) formed with a ribbed construction of fabric utilizing yarn including strands having medium stretchability. Such strands may be formed of a material such as lycra coated with nylon and which may also be of a relatively thicker denier. Additionally, the bra includes a region (10), disposed between regions (2), which is a relatively non-stretch region, utilizing mesh construction built using tuck, float or miss stitches. Channels (8) may be formed into the bra into which additional support material may be added.

In some embodiments, yarns may be used that incorporate strands formed from a thermoplastic material. Thus application of heat to specific areas of the bra may cause the thermoplastic strands to melt. Following the melting of individual thermoplastic strands, molten material either surrounds unmolten strands or intermingles with molten material from other thermoplastic strands. The molten material solidifies as the temperature is reduced thereby forming fused areas having altered properties, such as reduced elasticity, increased stiffness and stretch-resistance, enhanced abrasion-resistance, and increased durability.

Figure 9A:
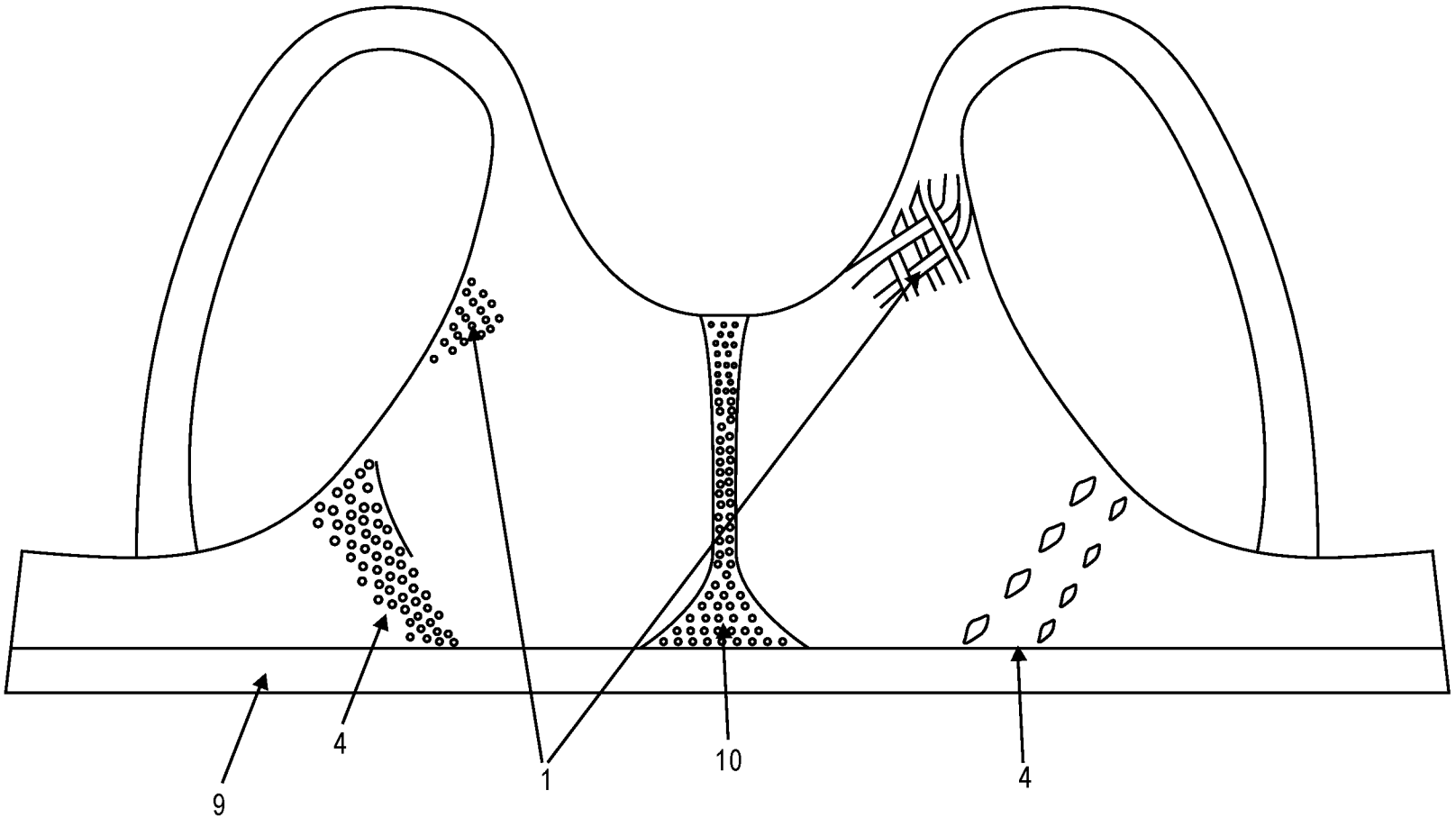
FIG. 9A is a schematic of a bra according to an embodiment of the invention having specific braid structures in specified fabric zones to achieve advantageous thermoregulation characteristics.
Figure 11A:
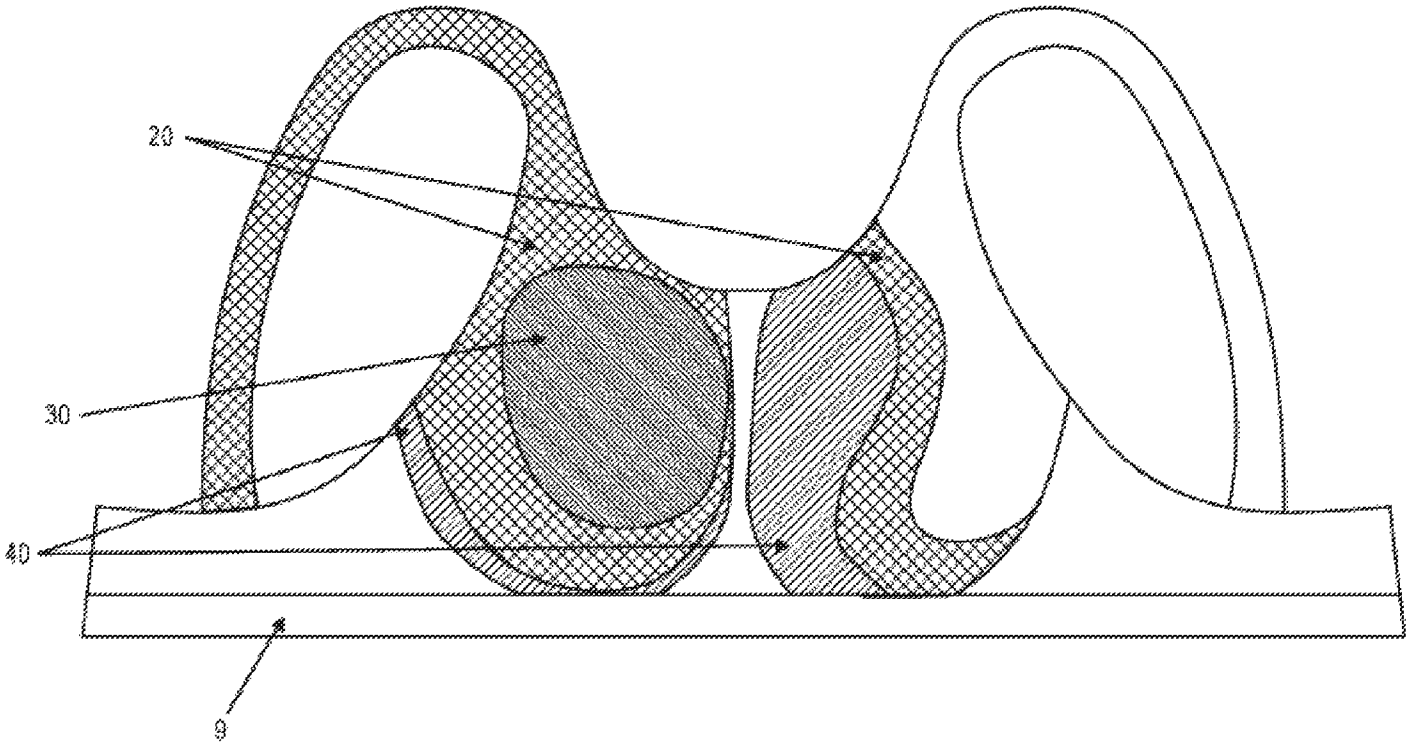
FIG. 11A is a schematic of a bra in one embodiment of the invention which illustrates varying the braid pattern by increasing or reducing courses of spacer in the cup region to create variations in cup shape to achieve a particular cup design.

In various embodiments, banded regions, e.g., region (9) with reference to FIG. 8, 9A or 11A utilize a specific combination of yarns. For example, the band region utilizes 2 ends of 200 denier spandex yarn double covered by 44 denier and 48 filament air texturized nylon yarn. In embodiments the yarn may be 70 denier to 300 denier spandex double covered or single covered or air covered by 40 denier to 165 denier yarn with various filaments.

An alternative to the bra embodiment depicted in FIG. 8 is a bra generally having similar regions as that shown in FIG. 8, but that is a three-dimensional knit bra that has seamless transitions between the various regions that have different characteristics. The bra may also include particular braid structures that are seamlessly incorporated throughout various regions. In embodiments, the bra includes combinations of the following structural features/regions: thermoregulation, dynamic dampening, spacer/padding/modesty, power and stretch, mesh, connections without components, holes, shaped cups (shaped without inserts or molds) and/or non-chafe yarns/zones (including plaited).

As such, in various embodiments, the bra of the present invention may include features that provide advantageous thermoregulation characteristics. In embodiments, thermoregulation may be achieved by incorporation of channels, mesh, holes, varying the thickness of fabric and the like. Without compromising the support a bra provides, the bra can be knit using a seamless combination or multiple knit combinations. Areas of a bra are targeted for inclusion of thermoregulation structures are those where moisture and heat normally get trapped between layers of fabric, glue, and bulky sewing constructions.

The thermoregulation features may be included using various knitting strategies. Flat bed knitting allows a single layer to be knit into the bra in heat trapping areas while keeping the structural integrity of the bra. A method of transferring the stitches between the two needle beds creating mesh and holes is another method of creating breathability without compromising the support of the bra. Additionally, hydrophobic and hydrophilic yarns may be added by plaiting on the inside or outside of the bra in these areas that help channel the moisture away from heat trapping areas. Using a double bed structure that creates ridges of fabric where moisture and heat can escape through these areas allows the knitting structure to not be directly against the skin when worn.

Figure 9B:
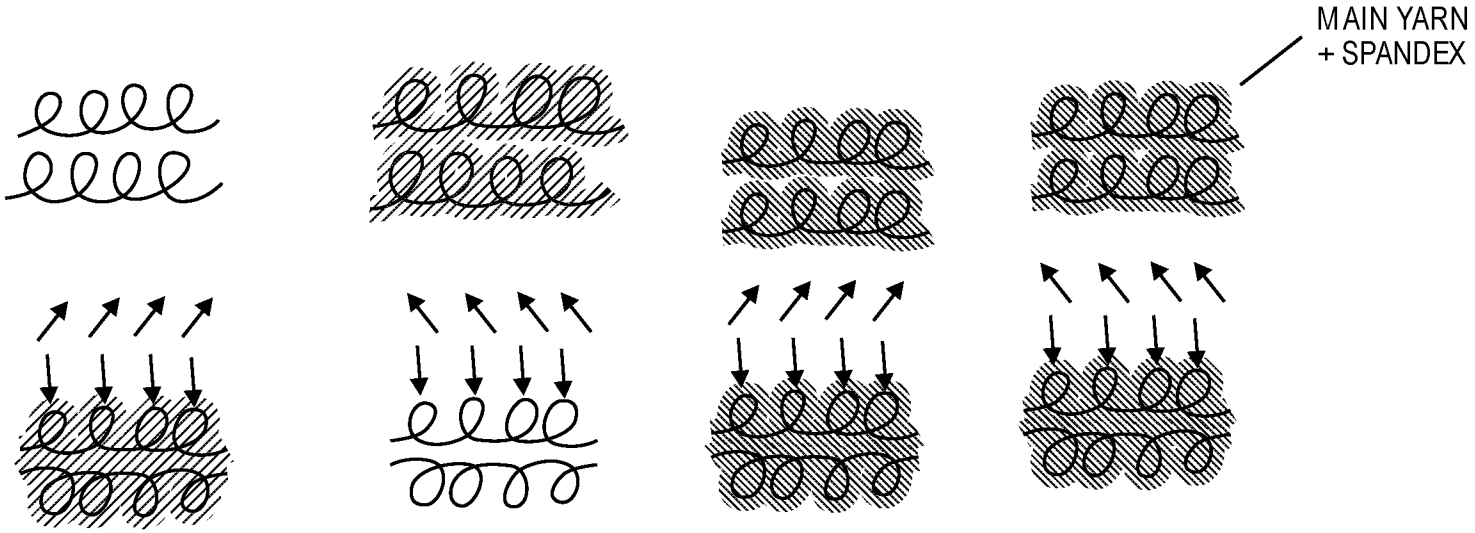
FIG. 9B is a schematic showing specific braid patterns utilized in fabric zones of the bra depicted in FIG. 9A.
Figure 10:
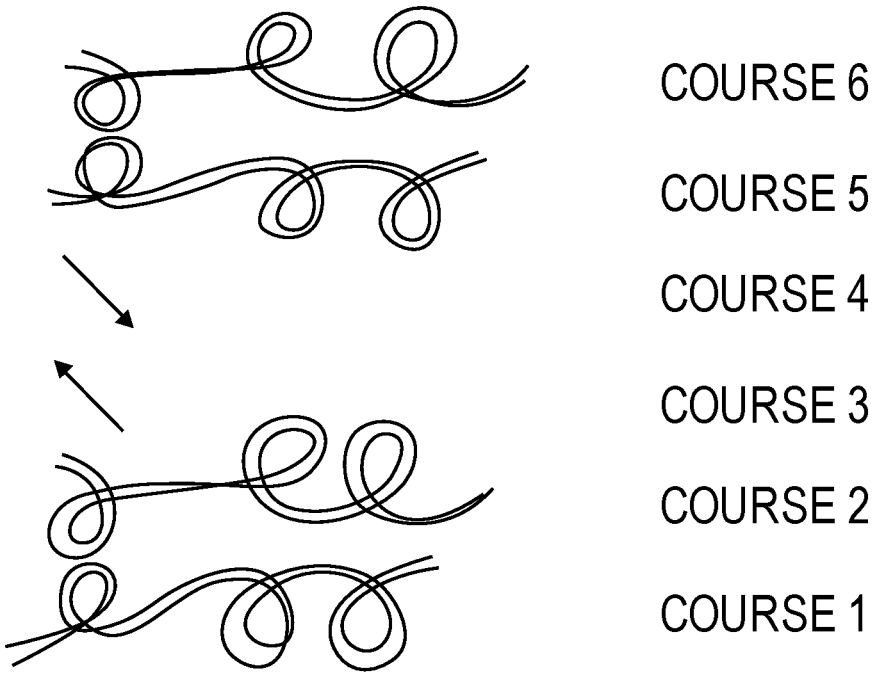
FIG. 10 shows a specific braid pattern utilized in the bra of FIGS. 9A-9B to create a mesh fabric, with course 6 including the main yarn and course 1 including a spandex yarn.
Figure 18:
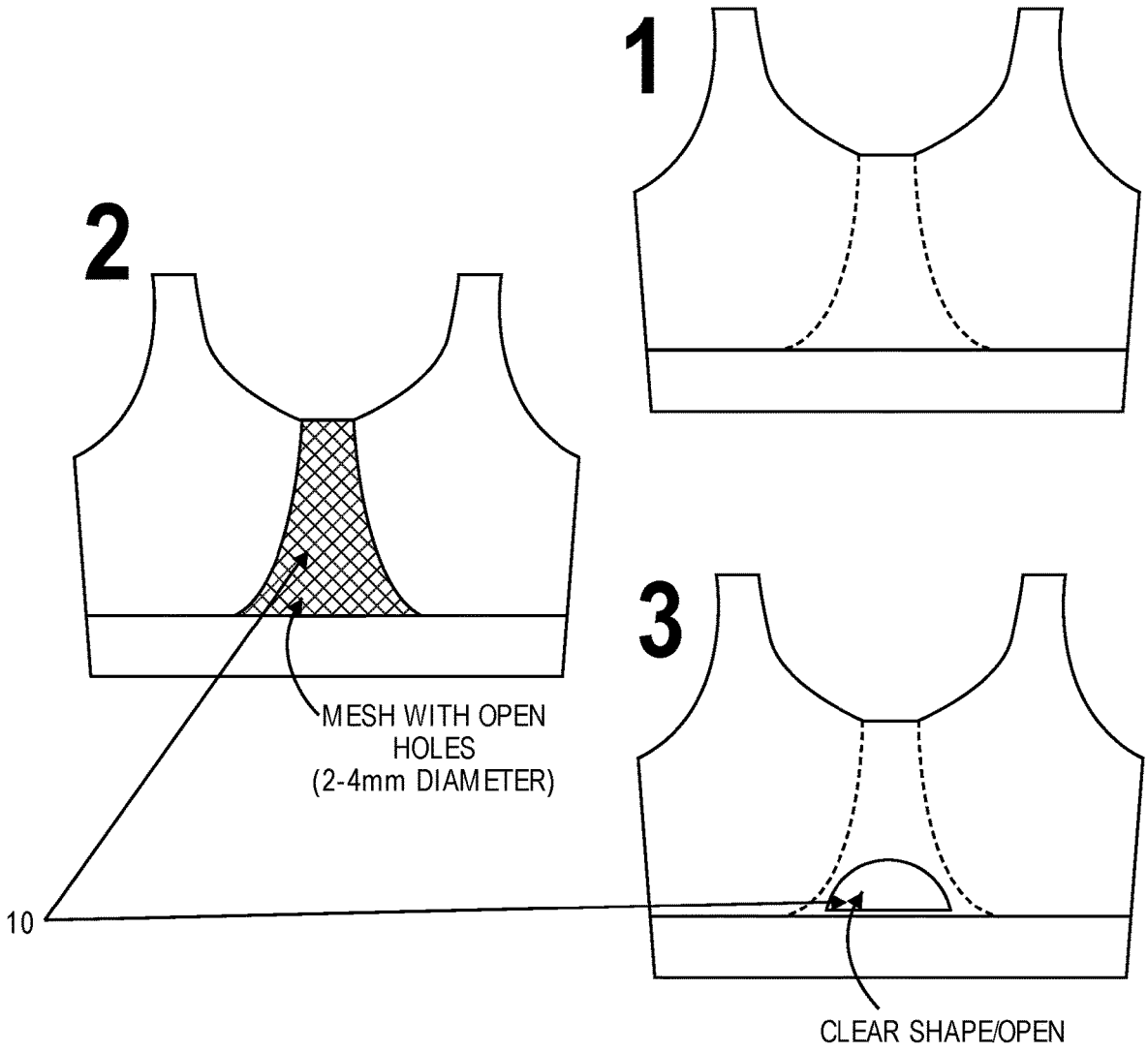
FIG. 18 is a series of schematics depicting alternative braid designs for use in the region between cup regions including use of mesh and regions void of fabric.

With reference to FIG. 9A, an embodiment of the bra is depicted having various regions including thermoregulation features. For example, wing regions (4) may include mesh or holes. Similarly, regions (2) and (10) may include mesh, while region (1) may also include a braid incorporating channels. One skilled in the art would understand that the thermoregulation features illustrated in FIG. 9A may be used in any combination. For example, FIG. 18 depicts bras including mesh at region (10) or alternatively a hole in region (10). However, it is envisioned that region (10) may include both meth and one or more holes in combination. This also holds true for regions (1) and/or (4). Further, it is to be understood that thermoregulation features may be included in other regions of the bra. FIG. 9B illustrates specific knit structures for use creating the various thermoregulation features. In particular, FIG. 10 illustrates a specific knit structure for creation of mesh fabric wherein course 6 includes a main yarn and course 1 includes an elastic yarn such as spandex.

In various embodiments, the bra of the present invention may include features that provide dynamic dampening, spacer regions, padding, modesty control and cup shaping. By knitting transitional knit structures with different fabric modulus, gradients of thickness, elasticity, stability, and shape, these technological features can be shaped dimensionally into a region, such as the cup region. Flat bed knitting can create two very different layers that are shaped as one cohesive piece, seamlessly, knit using a highly elastic yarn with a high stretch modulus while the outer layer of the cup is knit with a semi stretching layer, which results in the two seamlessly shaped layers being able to move independently of one another.

In various embodiments, spacer regions, include 2 plies of spacer yarn texturized polyester T400 (manufactured by Invista; 165 denier, 68 filament); or 100 denier, 36 filament, or monofilament 30 to 150 denier polyester or nylon yarn. In embodiments, spacer yarn is a shape memory alloy or shape memory polymer, such as polyester (intermingled PES/SET), 2 ply (334 decitex, 72 filament). In an embodiment, a fusible yarn to add rigidity is added, such as Grilon® LT (110 decitex, 14 filament).

Figure 13A:
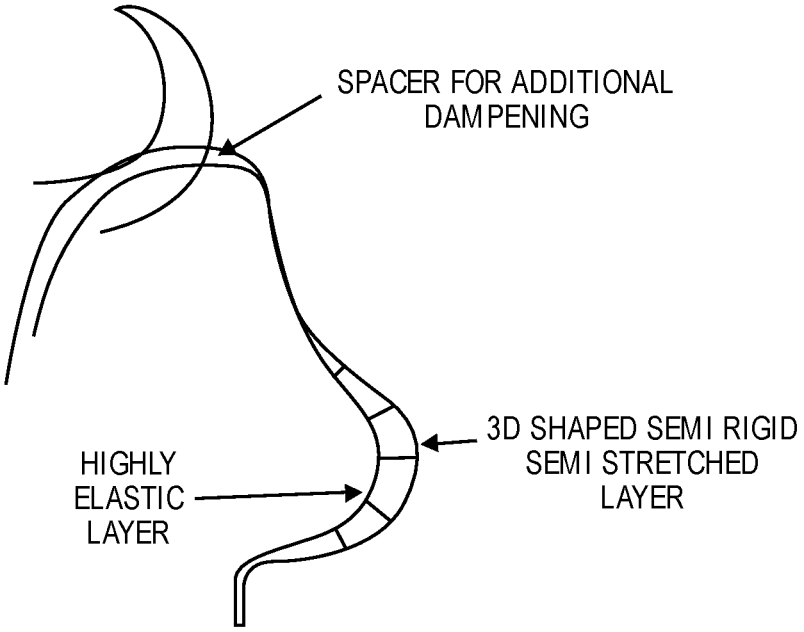
FIG. 13A is a cross-sectional view of the cup and spacer region of a bra in one embodiment of the invention having a particular fabric structure to provide additional dampening.
Figure 13B:
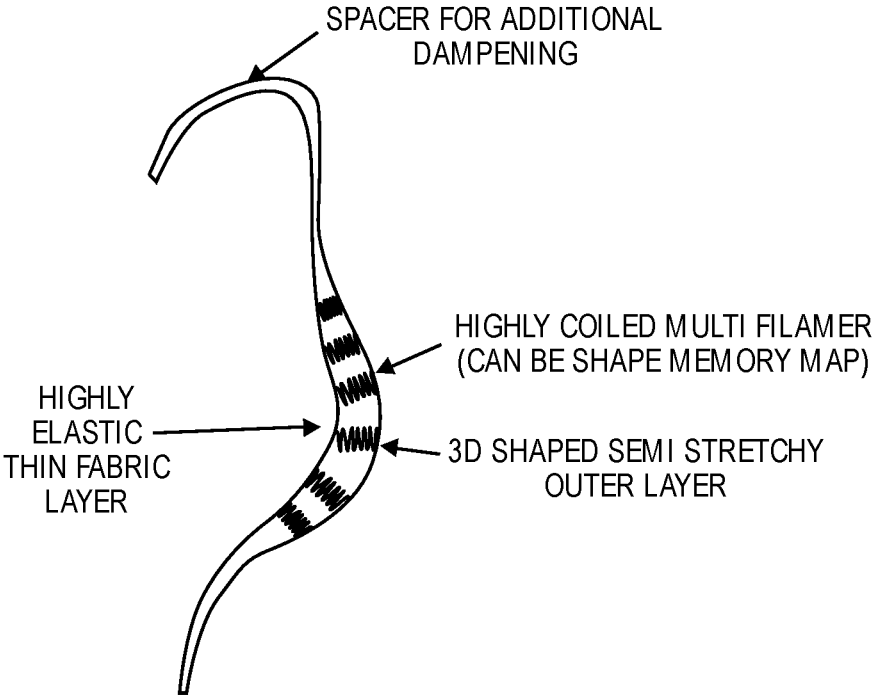
FIG. 13B is a cross-sectional view of the cup and spacer region of a bra in one embodiment of the invention having a particular fabric structure to provide additional dampening.
Figure 14:
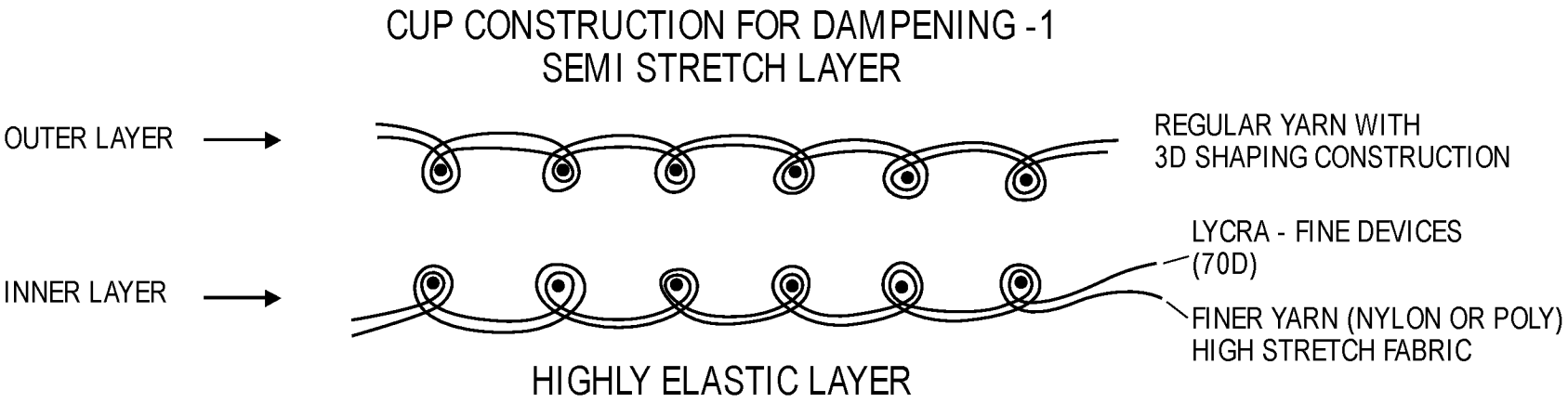
FIG. 14 is a schematic showing a specific knit structure for use in the cup region of a bra in one embodiment of the invention having a particular structure to provide dampening.
Figure 15:
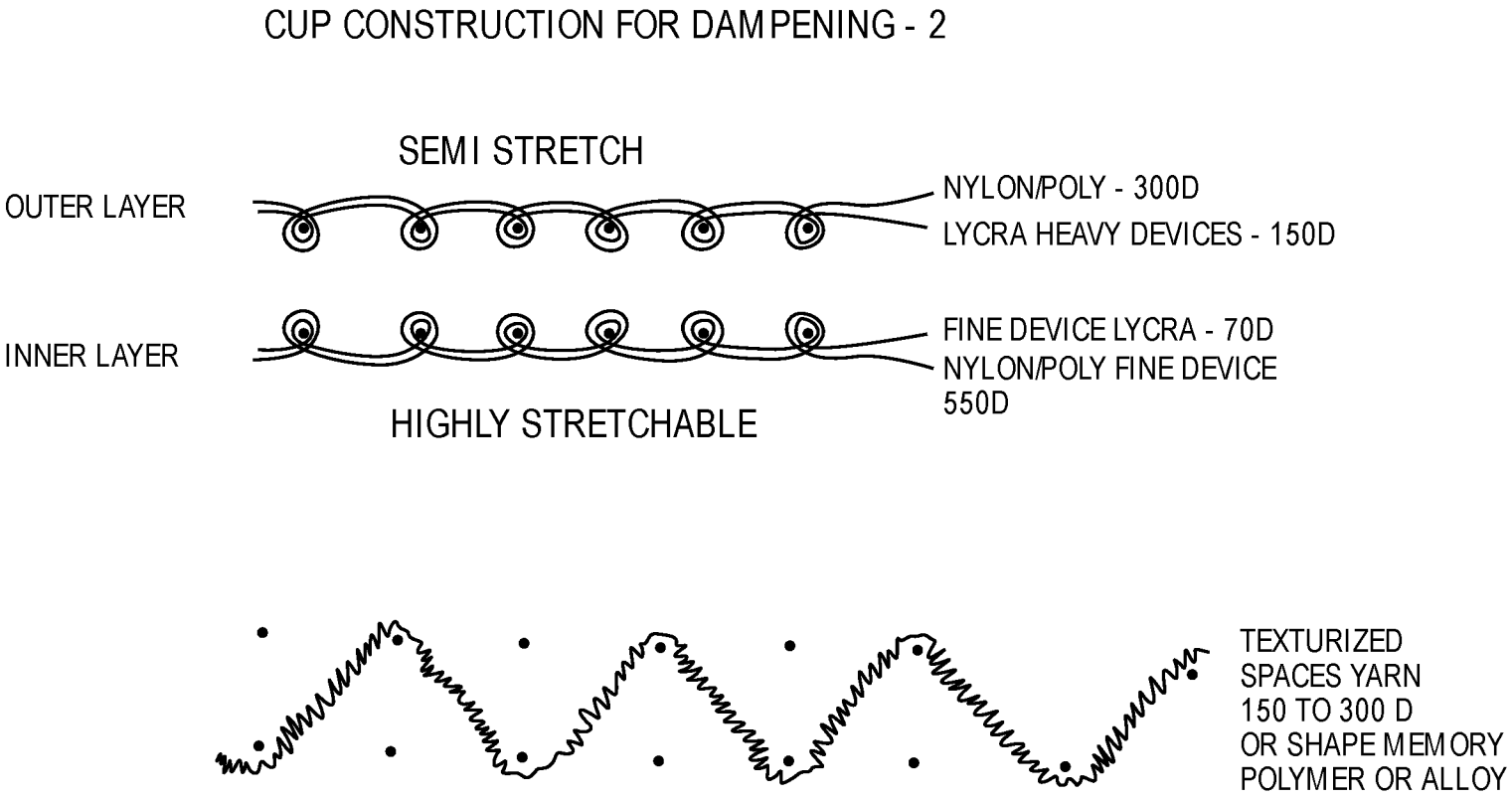
FIG. 15 is a schematic showing a specific knit structure for use in the cup region of a bra in one embodiment of the invention having a particular structure to provide dampening.

Embodiments of cup configurations having dynamic dampening features are shown in FIGS. 13-15. FIGS. 13A and 13B depict embodiments, in which the bra has an interior cup fabric layer which is highly elastic opposing an outer cup fabric layer of a three-dimensionally shaped semi rigid layer optionally including a highly coiled multifilament fiber (e.g., shape memory material such as polymer or alloy). In embodiments, the highly elastic interior layer has a modulus of elasticity of less than about 10, 20, 30, 40, 50, 60, 70, 80 or 90 percent of that of the less elastic outer layer. In embodiments, the less elastic outer layer has a modulus of elasticity of more than a factor of about 1.5, 2, 5, 10, 20, 30, 40, 50, 75 or 100 times that of the highly elastic interior layer. Specific knit configurations are shown in FIGS. 14 and 15.

Figure 17:
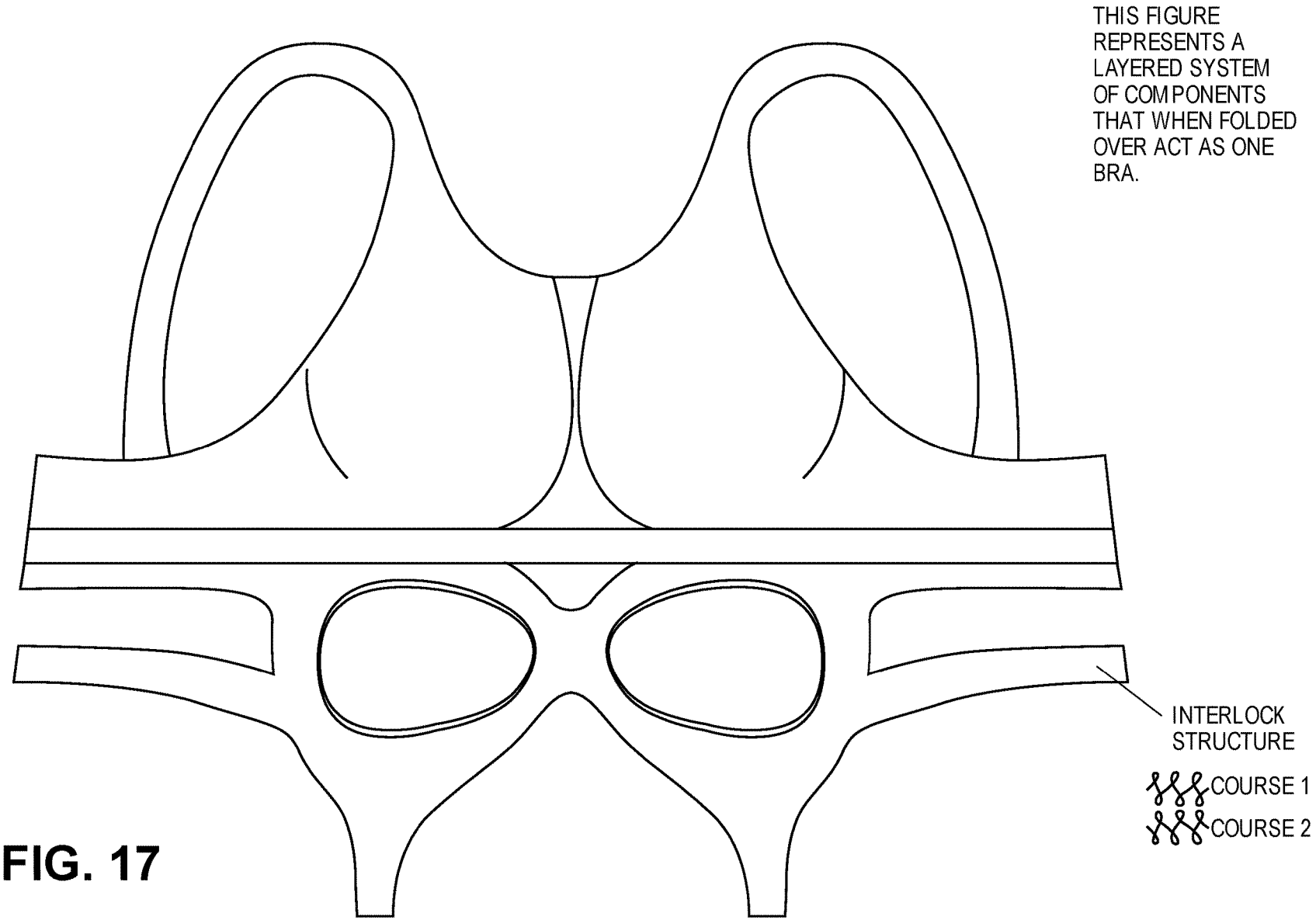
FIG. 17 is a schematic of a bra according to an embodiment of the invention illustrating a layered system of components. The bra is folded along the band region to create a unitary bra structure.

In embodiments, cups can be knit as separate layers using the back bed for the inner layer and the front bed for the outer layer, connecting only targeted areas as the style of the cup directs. In an alternative embodiment, cups are created as two layers that are connected with a desired sized yarn, or shape memory polymer or alloy, all as the same construction throughout the shaped cup or as a combination of various structures to achieve targeted results and functions of a cup purpose. FIG. 17, illustrates a layered system of components in which the bra is joined and folded along the band region to create a unitary bra structure.

Figure 11B:
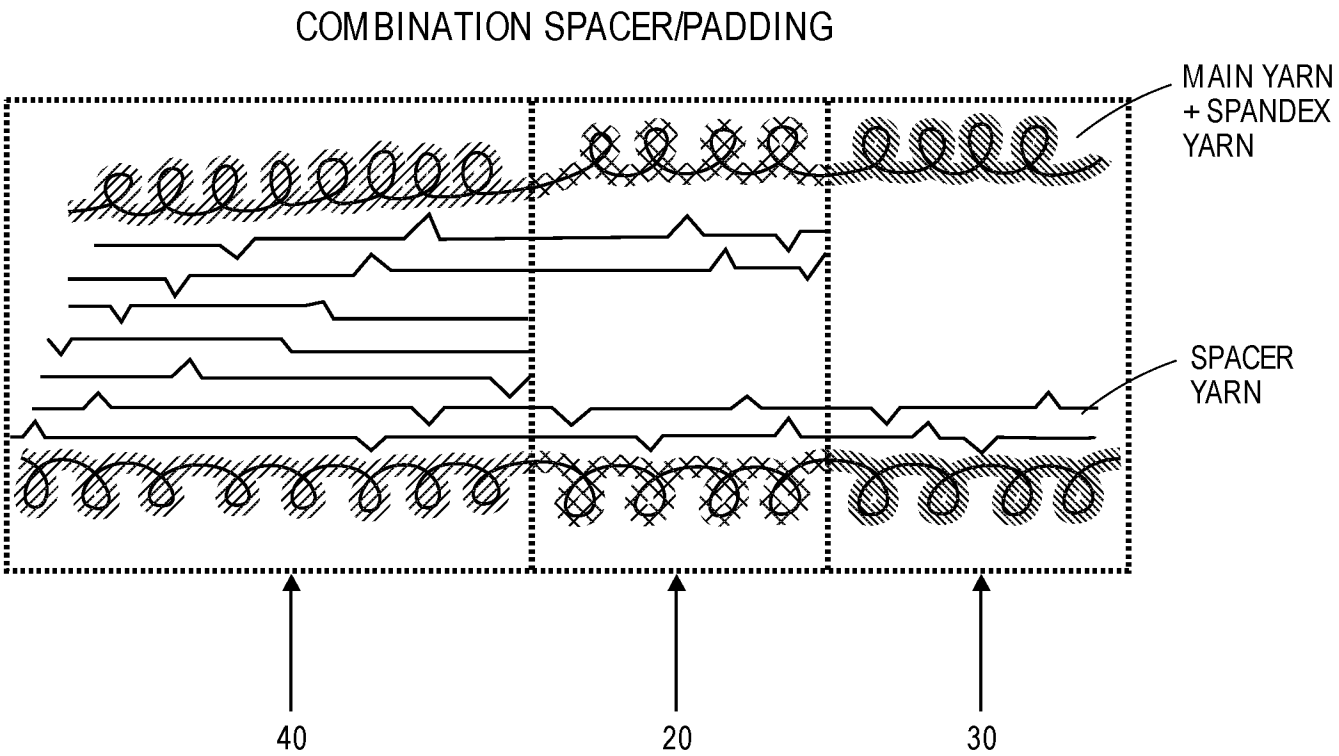
FIG. 11B is a schematic illustrating different braid patterns used in the cup regions shown in the bra of FIG. 11A.
Figure 12:
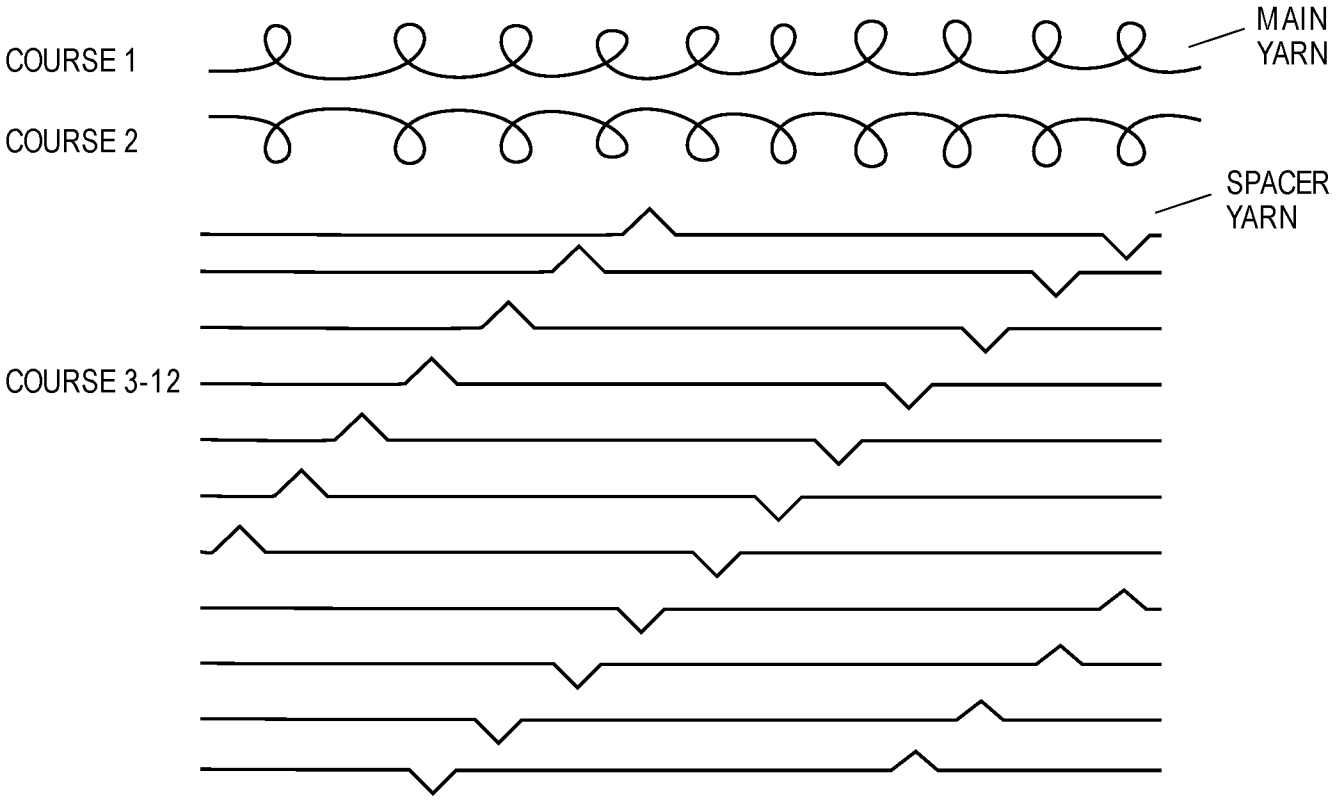
FIG. 12 is a schematic showing a specific knit structure for use in the cup and spacer region of the bra in one embodiment of the invention.

In various embodiments, the cups can transition through different thicknesses provided by the knit structure (e.g., inclusion of spacer or padding, or through the yarn used) as shown in FIG. 11A with specific knit structures shown in FIGS. 11B and 12. A thicker yarn can provide the same effect of padding as the knit structure without compromising the integrity of the cup or bra.

These dynamic dampening features are accomplished as a seamless transition of stitches provided by flat V bed knit technology. Utilizing a dual bed machine in which both front and back beds are used to knit dimensionally shaped fabric (e.g., cup regions) allows control of fabric properties by varying options including yarn type and size (monofilament, multifilament, regular/self-striping yarn, finer gauge, thicker gauge). Various methods of layering the inner yarn (such as lycra) on top of itself between the front and back needle bed, may be used to create a thick cup. This is better than the conventional method of molding cups, as it keeps the properties and modulus of the fabric intact. Conventional molding applies very high heat which damages the original fabric properties and also is not breathable.

Further, dynamic dampening structures may be incorporated by using a wedge (a knitting form of fabric darting) within the knitting program, a knitting structure can be shaped dimensionally within one whole fabric. The rows of knitting are led into the wedge, knit in between the wedge area (referred to as a short rowing), then the wedge ends on a row that leads the yarn out. This can be done using various knitting combinations of structures.

In various embodiments, the bra of the present invention may include features that provide additional power or stretch. In one embodiment, this is accomplished by adding a pretension to the lycra or yarn, such that the resulting knit is influenced with added power. The whole garment may be knit using the same pretension or, alternatively, specific regions can have a desired power or stretch modulus that is greater or less than other regions. Regions can be knit using separate yarn feeds and/or via pre-tensioner devices with a programmed and desired effect. In one embodiment, a separate yarn is used in an intarsia method. A tuck stitch is used to connect the separate yarns and knitting areas, creating a seamless knit piece with different stretch modulus in the same fabric. In another embodiment, an inlay method is used to add power to an area. By inlaying a powerful denier of lycra or covered spandex, a resulting powerful stretch modulus is knit. A non-stretching yarn could also be inlayed, creating a rigid non stretching fabric. The closer the inlay is in rows, the more powerful the modulus. In embodiments, a knit of fabric having a higher modulus of elasticity (higher power) is positioned directly adjacent a knit of fabric having a lower modulus of elasticity (lower power). In embodiments, the modulus of elasticity of a knit of fabric is less than about 10, 20, 30, 40, 50, 60, 70, 80 or 90 percent of that of a directly adjacent knit of fabric. In embodiments, the modulus of elasticity of a knit of fabric is more than a factor of about 1.5, 2, 5, 10, 20, 30, 40, 50, 75 or 100 times that of a directly adjacent knit of fabric.

In various embodiments, the bra of the present invention may include connection areas between regions that are without additional components (e.g., the knit transitions seamlessly between regions thereby connecting adjacent regions). When knitting with one yarn, knitting structures can transition seamlessly without needing to be joined. Many yarns and multiple knitting feeders can also be used in one row and joined seamlessly by tucking the yarn into the neighboring yarn field, regardless of the neighboring structure. The resulting fabric can be a combination of many structures containing all the same yarn type or a combination of many yarns with different properties to achieve desired modulus results. The components can be knit seamlessly from one structure to the next or purposely not connected and left as individual entities. Using an intarsia method, the yarn feeders and separate structures can be knit and never combined or combined purposely in supporting areas only. Open areas that do not require any additional finishing can be used for breathability, extra supporting layers, or to create a specific stretch modulus between fabric structures. Using a combination of these various methods of combining fabrics generates an entirely finished knit garment that typically requires many processes to create.

Figure 16:
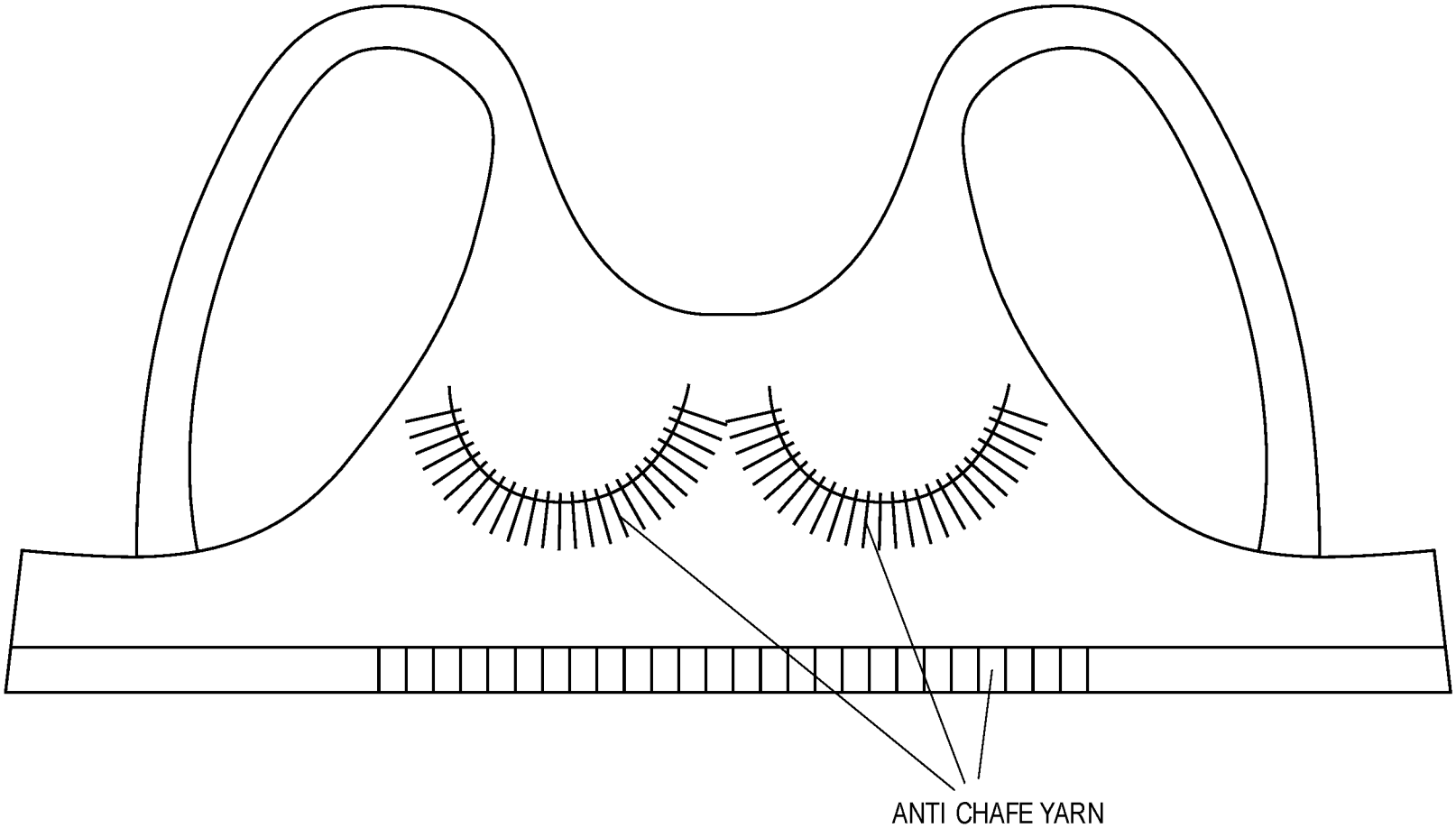
FIG. 16 is a schematic of a bra according to an embodiment of the invention having including anti-chafe yarn in specific regions (under band and cup regions).

In various embodiments, the bra of the present invention includes regions designed to chafing. Such regions may include yarn that is known for its anti-chafe properties. FIG. 16 illustrates an embodiment which includes anti-chafe yarn in the cup and under band regions. In embodiments, anti-chafe yarn is plaited. In further embodiments, anti-chafe yarn is incorporated only on the interior, skin contacting area of the bra. Exemplary yarns which are low chafing or low friction yarns include flat cross section nylon or polyester yarns from 60 denier to 300 denier. Other exemplary yarns include multifilament Teflon® or PTFE yarns of 70 denier to 300 denier. In embodiments, an anti-chafe yarn has a coefficient of friction of less than 0.9, 0.8, 0.7, 0.6, 0.5, 0.4, 0.3, 0.2, 0.1, 0.09, 0.08, 0.07, 0.06, 0.05, 0.04, 0.03, 0.02, 0.01 or less. In embodiments, the yarn has a coefficient of friction of between about 0.5 to 0.01, 0.4 to 0.01, 0.3 to 0.01, 0.2 to 0.01, 0.1 to 0.01, 0.05 to 0.01, 0.04 to 0.01, 0.3 to 0.01, or 0.02 to 0.01.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Although the present bra and process has been described with reference to specific details of certain embodiments thereof, it will be understood that modifications and variations are encompassed within the spirit and scope of the invention. Accordingly, the invention is limited only by the following claims.

What is claimed is:

1. A knit bra having enhanced performance and comfort, the knit bra comprising:

a first knitted region having a double knit three-dimensional structure shaped to conform to a three-dimensional shape of a wearer and formed by using a dual bed v-bed knitting machine, where both front and back beds of the knitting machine are used to knit of the double knit three-dimensional structure, wherein at least part of the double knit three-dimensional structure comprises a spacer yarn knit in between two layers of the double knit three-dimensional structure to form a spacer; and a second knitted region, wherein the first knitted region and second knitted region are joined by a seamless transition, and wherein a knit fabric in each of the first knitted region and the second knitted region include one or more types of yarns having one or more types of strands, and wherein a structural property of each of the first knitted region and the second knitted region is defined and varied by varying:

combinations of the one or more types of yarns fed into the front and back beds of the knitting machine, knitting constructions, yarn or yarns' tension, or the type of strand or strands of the one or more types of yarns; and wherein a thickness of the spacer varies by location in the knit bra.

2. The bra of claim 1, wherein the bra comprises two or more three-dimensional structures.

3. The bra of claim 1, wherein the fabric is formed of a first type of yarn.

4. The bra of claim 3, wherein the first type of yarn comprises strands of a single material.

5. The bra of claim 3, wherein the first type of yarn comprises strands of a first material and one or more additional materials.

6. The bra of claim 1, wherein the fabric is formed of a first type of yarn and one or more additional yarns.

7. The bra of claim 6, wherein the first type of yarn comprises strands of a single material.

8. The bra of claim 6, wherein the first type of yarn comprises strands of a first material and one or more additional materials.

9. The bra of claim 6, wherein the one or more additional yarns comprises strands of a single material.

10. The bra of claim 6, wherein the one or more additional yarns comprises strands of a first material and one or more additional materials.

11. The bra of claim 6, wherein the yarns are identical.

12. The bra of claim 6, wherein the yarns are different.

13. The bra of claim 2, wherein the bra comprises two three-dimensional structures, each shaped to conform to a different three-dimensional shape of an individual wearer.

14. The bra of claim 13, wherein the three-dimensional structures are shaped to conform to breasts of the wearer.

15. The bra of claim 1, wherein the bra is seamless.

16. The bra of claim 1, wherein the bra is an athletic bra.

17. The knit bra of claim 1, wherein the double knit three-dimensional structure comprises an outer layer having a first structural property and an inner layer having a second structural property, the outer layer and the inner layer are configured to move independently of one another.

18. The knit bra of claim 1, wherein the second knitted region is a single knit structure knitted using one of the front or back bed of the knitting machine.

19. The knit bra of claim 1, wherein the second knitted region is a double knit structure knitted using both of the front and back bed of the knitting machine.

20. The knit bra of claim 1, further comprising a braid region having at least one braid structure knitted seamlessly with at least one of the first or the second knitted region.

21. The knit bra of claim 1, further comprising a ridge region having at least one raised structure extending in a direction away from the skin of the wearer, the ridge region being knitted seamlessly with at least one of the first or the second knitted region.

22. The knit bra of claim 1, wherein the bra comprises two or more three-dimensional structures.

23. The knit bra of claim 1, wherein the first knitted region of the double knit three-dimensional structure is formed of a first type of yarn, and wherein the first type of yarn comprises strands of a single material or comprises strands of a first material and one or more additional materials.

24. The knit bra of claim 1, wherein the first knitted region of the double knit three-dimensional structure is formed of a first type of yarn and one or more additional yarns.

25. The knit bra of claim 22, wherein the first type of yarn comprises strands of a single material or comprises strands of a first material and one or more additional materials.

26. The knit bra of claim 1, wherein the second knitted region is formed of a first type of yarn.

27. The knit bra of claim 1, wherein the second knitted region is formed of a first type of yarn and one or more additional yarns.

28. The knit bra of claim 22, wherein the bra comprises two three-dimensional structures, each shaped to conform to a different three-dimensional shape of an individual wearer.

29. The knit bra of claim 1, wherein the bra is seamless.

30. The knit bra of claim 26, wherein the first type of yarn comprises strands of a single material.

31. The knit bra of claim 26, wherein the first type of yarn comprises strands of a first material and one or more additional materials.

* * * * *